US008790085B2

(12) United States Patent
Villella

(10) Patent No.: US 8,790,085 B2
(45) **Date of Patent: *Jul. 29, 2014**

(54) COMBINED CEILING FAN AND LIGHT FITTING

(75) Inventor: Joe Villella, Mill Park (AU)

(73) Assignee: Beacon Lighting International Limited (CN)

( * ) Notice: Subject to any disclaimer, the term of this patent is extended or adjusted under 35 U.S.C. 154(b) by 319 days.

This patent is subject to a terminal disclaimer.

(21) Appl. No.: 13/029,700

(22) Filed: Feb. 17, 2011

(65) Prior Publication Data

US 2012/0045331 A1 Feb. 23, 2012

Related U.S. Application Data

(63) Continuation of application No. PCT/AU2008/001874, filed on Dec. 19, 2008, and a continuation-in-part of application No. 11/995,585, filed as application No. PCT/AU2008/000981 on Jul. 13, 2006, now Pat. No. 8,317,470.

(30) Foreign Application Priority Data

| | | |
|---|---|---|
| Jul. 13, 2005 | (AU) | 2005903707 |
| Sep. 30, 2008 | (AU) | 2008905097 |
| Oct. 5, 2008 | (AU) | 2008905201 |

(51) Int. Cl.
*B64C 11/28* (2006.01)

(52) U.S. Cl.
USPC ..... 416/140; 416/143; 416/223 R

(58) Field of Classification Search
USPC ..... 416/5, 87, 131, 135, 136, 137, 140, 416/142, 143, 243, DIG. 2, DIG. 5
See application file for complete search history.

(56) References Cited

U.S. PATENT DOCUMENTS

| | | | | |
|---|---|---|---|---|
| 1,361,785 | A | 12/1920 | Tucker | |
| 1,445,402 | A * | 2/1923 | Le Velle | 416/87 |
| 1,458,348 | A | 6/1923 | Le Velle | |
| 2,079,942 | A * | 5/1937 | Le Velle | 416/87 |
| 3,692,427 | A * | 9/1972 | Risse | 416/143 |
| 4,776,761 | A | 10/1988 | Diaz | |
| 5,672,002 | A | 9/1997 | Todd, Jr. | |
| 6,010,308 | A * | 1/2000 | Youn | 416/237 |

(Continued)

FOREIGN PATENT DOCUMENTS

WO 2007006096 A1 1/2007

OTHER PUBLICATIONS

International Search Report for PCT/AU2008/001874, Completed by the Australian Patent Office on Feb. 18, 2009, 4 pages.

*Primary Examiner* — Ned Landrum
*Assistant Examiner* — Ryan Ellis
(74) *Attorney, Agent, or Firm* — Brooks Kushman P.C.

(57) ABSTRACT

There is provided a combined ceiling fan and light fitting (10) having blades (1-4) that when the ceiling fan is not in use retract and are stowed above an enclosure (12) containing a light emitting device and that when the fan is in use are extended under centrifugal force. The blades are formed in such a way as to both stow compactly above the enclosure and provide reasonable aerodynamic performance. Each blade partially overlies a neighboring blade when in its stowed position and the blades are so formed as to permit such stacking while limiting the overall height of the assemblage of stowed blades.

29 Claims, 19 Drawing Sheets

(56) References Cited

U.S. PATENT DOCUMENTS

| | | | | |
|---|---|---|---|---|
| 6,213,716 | B1 | 4/2001 | Bucher et al. | |
| 6,309,083 | B1 | 10/2001 | Lathrop et al. | |
| 6,666,652 | B2 | 12/2003 | Bucher et al. | |
| 6,719,533 | B2 | 4/2004 | Bird | |
| 7,037,074 | B2 | 5/2006 | Hoshino | |
| 7,131,819 | B2 * | 11/2006 | Bird | 416/238 |
| 7,210,910 | B1 * | 5/2007 | Parker et al. | 416/243 |
| 7,625,186 | B1 * | 12/2009 | Lueddecke | 416/243 |
| 7,857,581 | B2 * | 12/2010 | Mons et al. | 415/173.5 |
| 2006/0140769 | A1 | 6/2006 | Frampton et al. | |

* cited by examiner 10
61a
1a
7
θ=0°
44
θ
82
63
80
21
51a
80
42
3
12
4
64
26
θ=270°
θ=90°
15
14
22
24
62
2
1b
61b
23
θ=180°

1a
61a 10
8
7
6
5
4
3
2
1
100
100
94
92
101
102
21
51a
94
52
22
15
24
54
62
2
92
1b
26
23
53
61b

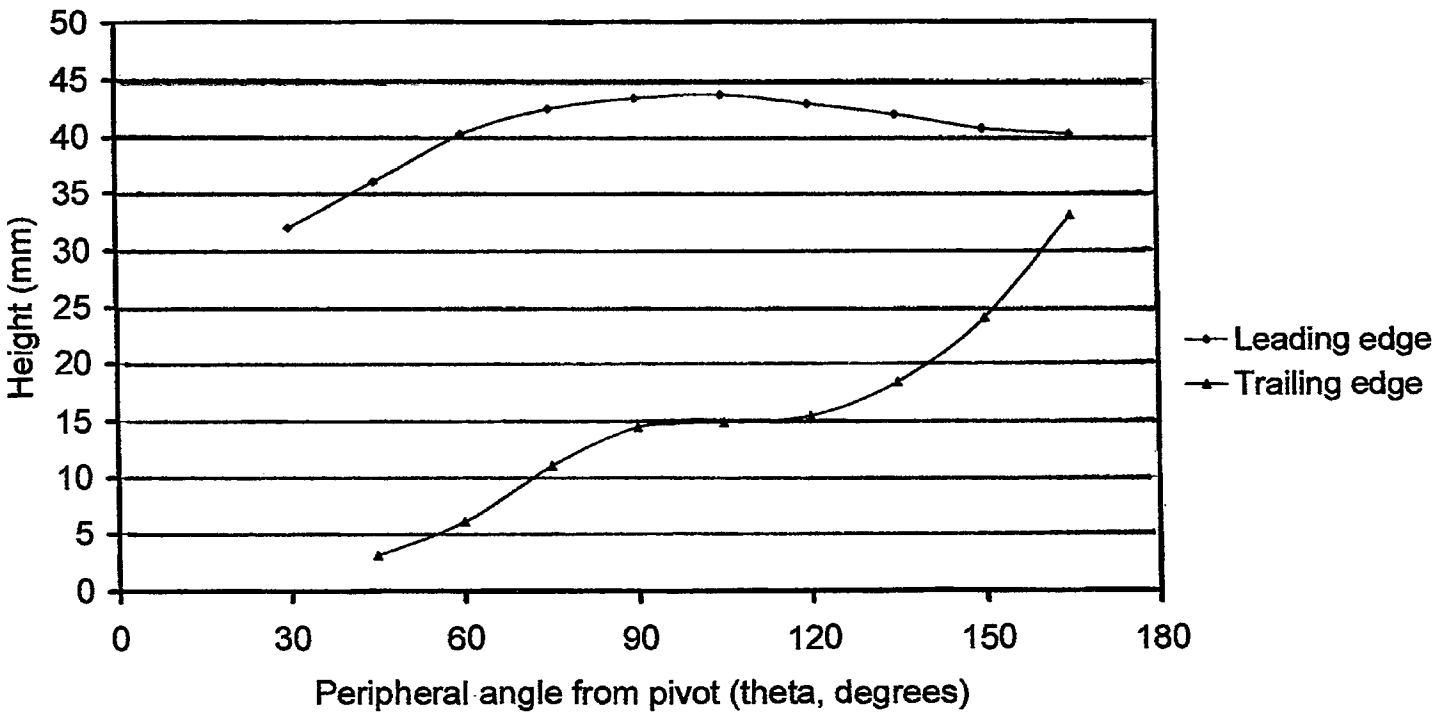
Fig. 13 - Blade inner and outer edge heights

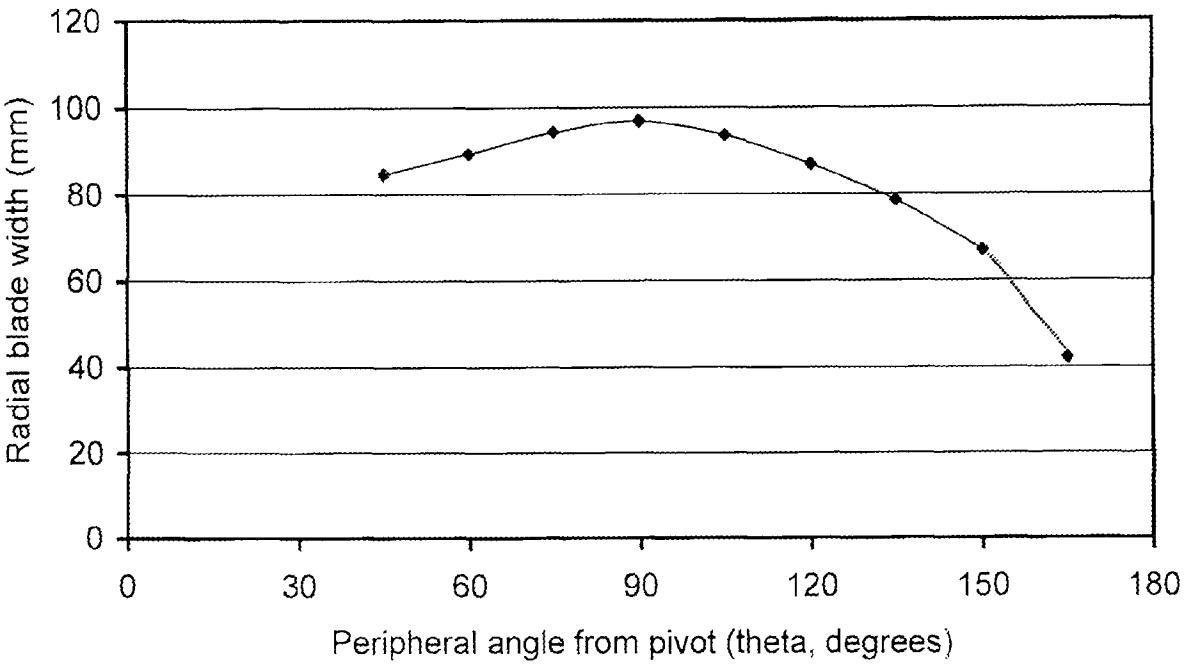
Fig. 14 - Blade width (radial, when folded)

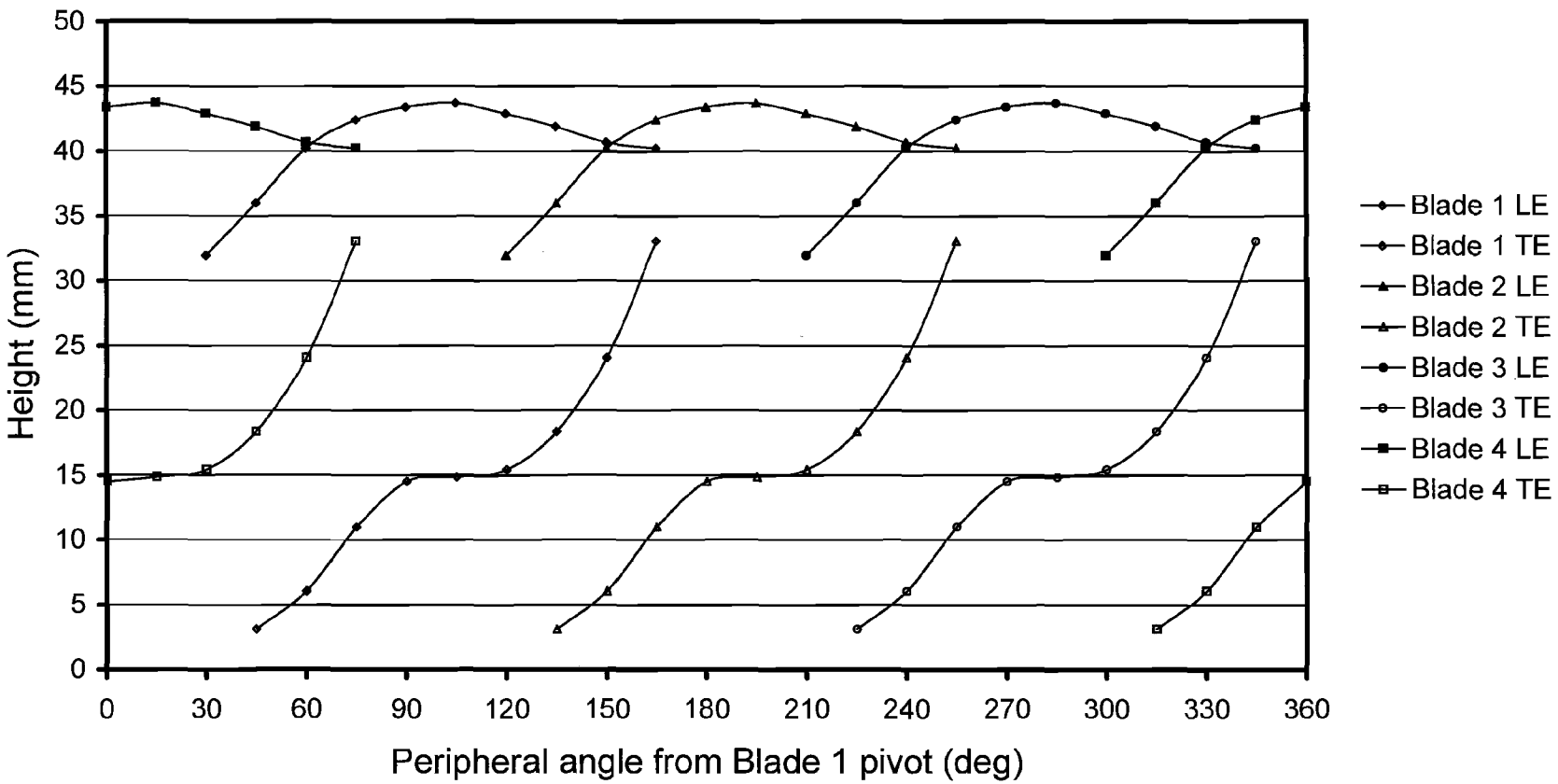
Fig. 15 - Blade inner and outer edge heights

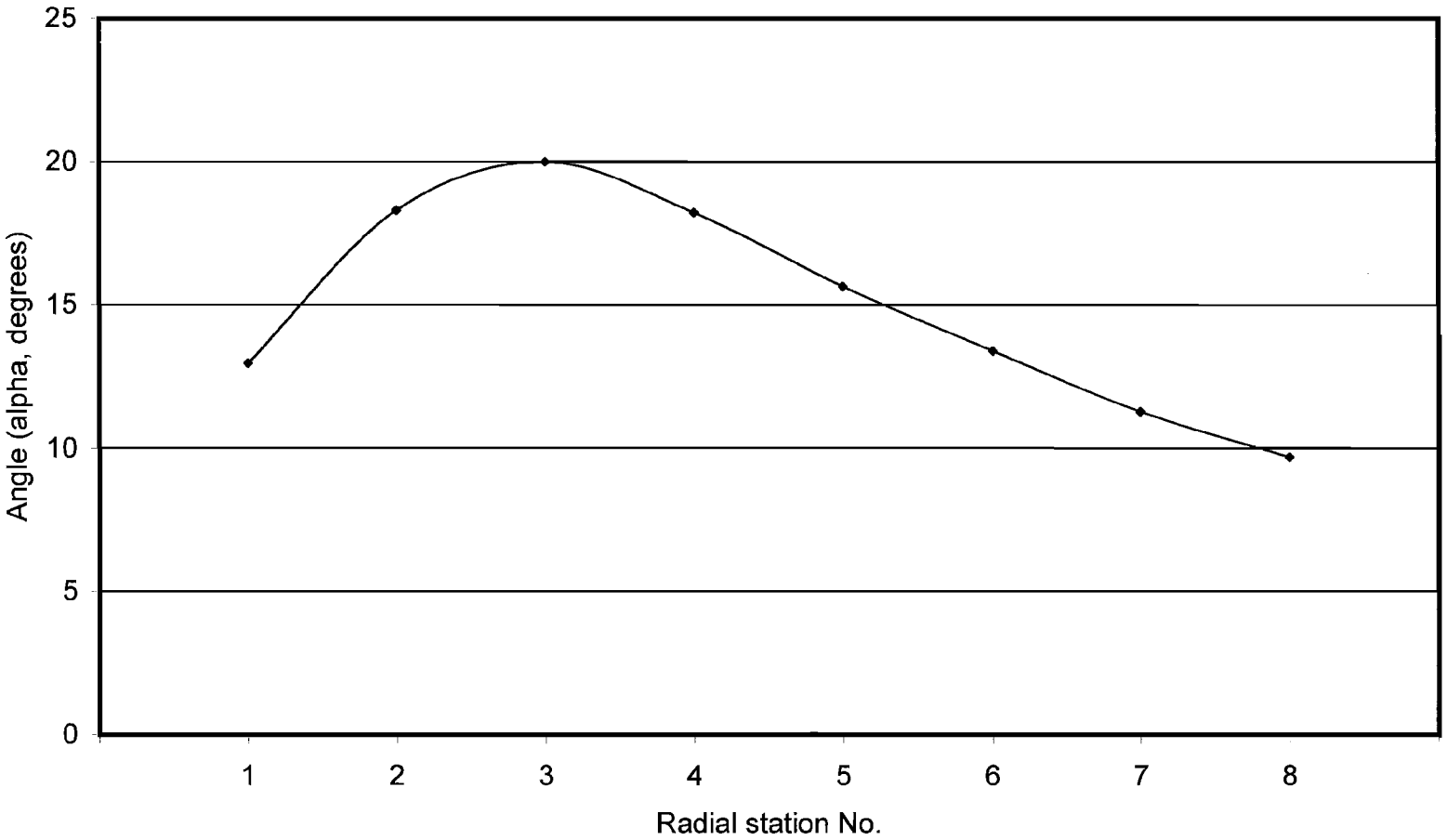
Fig. 17 - Blade angle of incidence (to horizontal) at radial stations

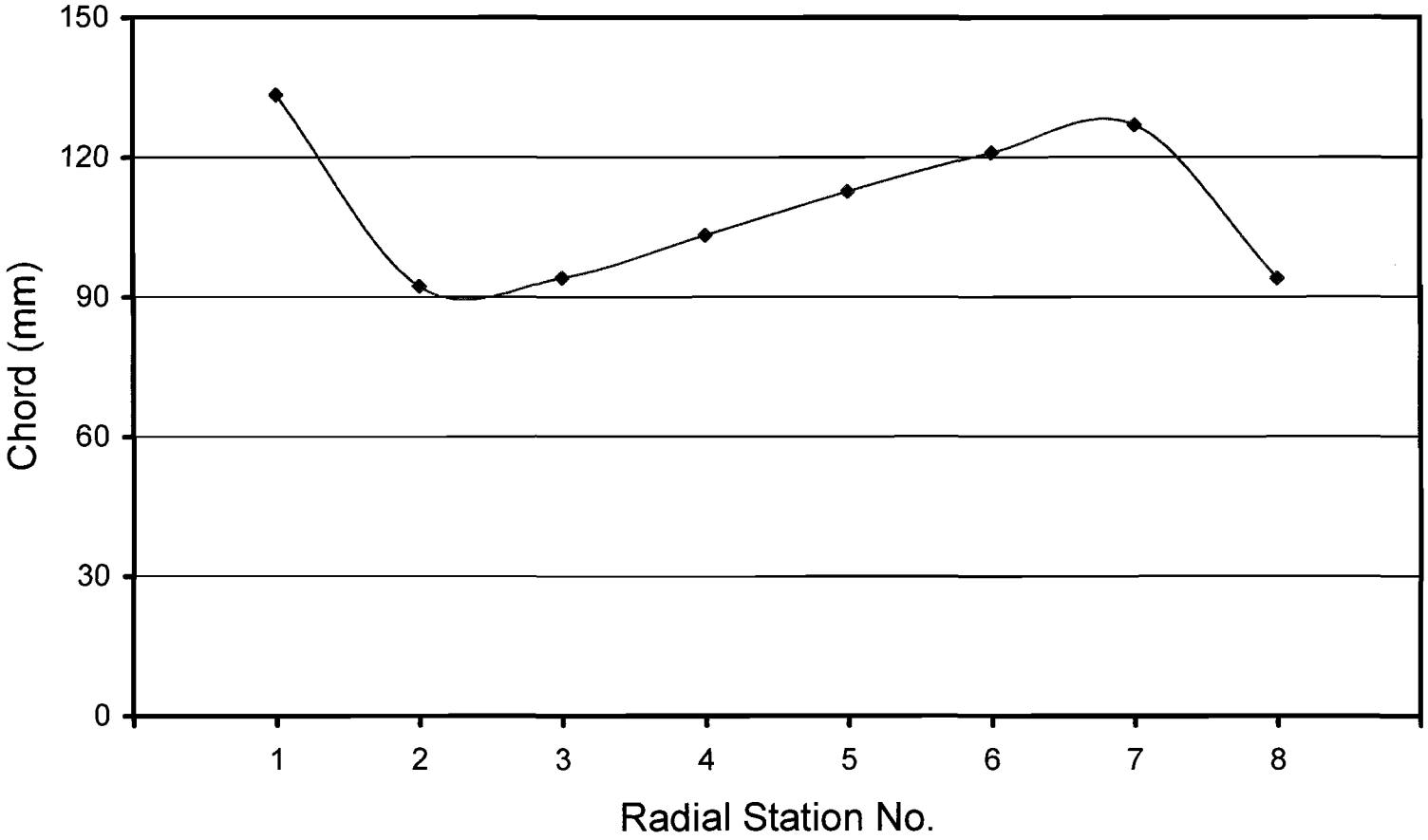
Fig. 18 - Blade chord at radial stations

COMBINED CEILING FAN AND LIGHT FITTING

CROSS-REFERENCE TO RELATED APPLICATIONS

This application is a continuation of International application PCT/AU2008/001874 filed Dec. 19, 2008, which, claims priority to AU2008905097 filed Sep. 30, 2008 and AU2008905201 filed Oct. 5, 2008. This application is also a continuation-in-part of U.S. application Ser. No. 11/995,585 filed Jan. 14, 2008, now U.S. Pat. No. 8,317,470, which is incorporated in its entirety by reference herein, which is a U.S. national phase of International application PCT/AU2006/000981 filed Jul. 13, 2006, claiming priority to AU 2005903707 filed Jul. 13, 2005.

TECHNICAL FIELD

The invention described herein relates to a combined light fitting and ceiling fan having blades that are compactly folded when the fan is not in use and that move outwardly when the fan is started. More particularly the invention relates to improved fan blades for such an appliance.

BACKGROUND

Ceiling fans have long been recognized and used as an inexpensive way to provide movement of air within rooms of buildings. They can be simple to use and install, safe, and inexpensive to buy and run when compared to such alternatives as for example refrigerated and evaporative air conditioning units. They can often provide a surprisingly effective alternative to air conditioning as the air movement they generate can evaporate skin perspiration with a resulting cooling effect.

It is known to combine ceiling fans with lighting means, as firstly it is a common requirement to provide ceiling mounted light sources, and secondly it is convenient to provide a single power supply to operate a combined fan and light fitting.

Less commonly, it has also been known to provide a combined light fitting and ceiling fan with some form of folding or retracting blade arrangement. Le Velle has described three versions. U.S. Pat. No. 1,445,402 discloses a light fitting and ceiling fan in which blades move outwards under centrifugal force when the fan is switched on, and are retracted by springs when the fan is switched off. U.S. Pat. Nos. 1,458,348 and 2,079,942 disclose improved versions, in which (unlike the early version of U.S. Pat. No. 1,445,402) the inward and outward movements of the blades are synchronized. Synchronizing blade movement is important for preserving satisfactory balance of the rotating parts of the fan. More recently, a combined light fitting and ceiling fan has been disclosed by Villella (see international patent publication WO 2007/006096) with a concealed and simple blade movement synchronizing arrangement that lends itself to modern design.

A problem in the design of a combined light fitting and ceiling fan is to provide blades that when in use can provide useful air moving performance without requiring excessive power and that when not in use can fold into a reasonably compact overall form. The present invention addresses this problem.

References above and elsewhere in this specification to certain patents are not intended as or to be taken as admitting that anything therein forms a part of the common general knowledge in the art in any place.

SUMMARY

A combined ceiling fan and light fitting will in this specification be referred to as a fan/light for convenience and brevity.

The invention relates to fan/lights having a plurality of fan blades that move outwardly to operating positions during fan operation and inwardly to stowed positions when fan operation ceases. Movement of the fan blades outwardly may be by action of centrifugal force when the blades are rotated about a fan axis by a motor. Retraction of the fan blades to their stowed positions may be by action of resilient means, for example one or more springs.

The blades are adapted and arranged when in their operating positions to move air downward as they rotate, and when in their stowed positions to lie within a defined radius from the fan axis, such as the radius of a translucent enclosure of circular form (when seen in plan view) for light emitting devices such as incandescent lamps. Each blade when stowed may overlap at least one other blade.

Preferred forms and relative positionings of blades are disclosed that are believed to provide a useful balance between the requirements of reasonable air movement and compact stowage of the blades when not in use. These forms are particularly characterized by certain distributions of incidence, blade chord (distance measured from leading edge to trailing edge) and dihedral. They are preferably of aerofoil cross section with such camber that lower blade surfaces are concave and upper blade surfaces convex.

More specifically, the invention provides in a first aspect a combined ceiling fan and light fitting having a plurality of fan blades, wherein:

each blade is pivotally mounted so as to be pivotable about an upright pivot axis of the blade between a stowed position and a deployed position;

each blade when in its stowed position lies within a specified radius from an upright fan rotation axis and above a light fitting portion and has an air moving portion that in the deployed position of the blade extends beyond said specified radius; and each blade is generally elongate and arcuate when seen in plan view and in its stowed position extends peripherally within said specified radius between its pivot axis and a tip end of the blade and partially overlies a neighbouring one of the blades in its own stowed position;

the combined ceiling fan and light fitting characterized in that:

(a) each blade initially rises in height above a datum height with increasing distance along the blade from its pivot axis end so that the blade when in its stowed position overlies the pivot axis end of the neighbouring blade in its own stowed position and (b) with increasing distance from a pivot-axis end of the air moving portion towards the tip end of the blade the leading edge of the air moving portion first increases in height above the said datum height and then turns downwardly whereby to limit the height of the tip end above the datum height.

The term "neighbouring blade" here means a blade that is first found by moving peripherally forward (i.e. in the direction of fan rotation) from one blade.

The phrase "turns downwardly" here does not necessarily mean that with increasing distance toward the tip end from such turning down the blade begins to actually descend. Rather it means that the blade increases in height at a lesser rate than before the turning down, which may still be positive although that is not to preclude a zero or negative rate of height increase.

Thus, the leading edge of the air moving portion of each blade may have a peak height above the datum height at a position between the pivot-axis end of the air moving portion and the tip end of the blade.

Further, the height above the datum height of the leading edge of the air moving portion may decline from said peak height with increasing distance along the leading edge toward the tip end of the blade.

The "specified radius" may be approximately a radius of a light fitting portion that is comprised in the combined ceiling fan and light fitting and located below the blade and that is of circular shape when seen in plan view.

The "datum height" may, purely for example, be the height of an upper surface of a horizontal platelike member to which each of the blades is pivotably mounted as in the case of the construction described by Villella.

The air moving portion of each blade may have a trailing edge that when seen in plan view is approximately a circular arc which when the blade is in its stowed position said is substantially centred on the fan rotation axis. This arrangement allows effectively use of the available space above a light fitting portion that is round when seen in plan view.

Preferably, for each blade when in its stowed position the radial distance between the leading and trailing edges of the air moving portion reduces progressively (i.e. the blade tapers as seen in plan view) from a maximum value partway along the length of the air moving portion towards the blade tip end.

More preferably, when all blades are in their stowed positions there is for each blade a first point on the leading edge of its air moving portion where the blade overlies its neighbouring blade which first point when seen in a notional radial plane including the fan rotation axis lies at a greater radius than a second point in the same notional plane that is on the leading edge of the overlain neighbouring blade.

Still more preferably, the said first point may be at a height above the datum height not exceeding the height of the said second point.

These arrangements can enhance the compactness of stowage of the blades.

It is preferred that the air moving portion of each blade has in the deployed position of the blade a maximum angle of incidence to the horizontal at a position partway along the air moving portion the angle of incidence decreasing with increasing distance from that position of maximum incidence towards the tip end of the blade.

Preferably also, the air moving portion has a positive angle of incidence to the horizontal at its pivot-axis end.

The position partway along the air moving portion of each blade at which its incidence to the horizontal is a maximum when the blade is in its deployed position may be radially inboard of a position at which the blade chord measured along an arc centred on the fan rotation axis is at a maximum value. It is thought (but not asserted) that this feature may smooth the distribution of downward thrust on the air along the blade, so reducing induced drag on the blade.

Although adaptable to other numbers of blades, for example three or five, the number of blades is preferably four with the blades' pivot axes being spaced 90 degrees apart from each other peripherally.

That section of each blade between its pivot axis and its tip end when the blade is in its stowed position may subtend an angle of about 160 to 170 degrees at the fan rotation axis. Values in this range allow reasonable blade areas within the available stowage space above the light fitting portion, but without at any point requiring the stacking of more than two blades. This assists in obtaining compact blade stowage.

Preferably, each blade pivots through an angle of about 180 degrees to move from its stowed position to its deployed position. This gives a satisfactory blade-swept area for a given blade size.

Preferably, the air moving section of each blade is upwardly cambered (i.e. Concave downwards) between its leading and trailing edges when seen in cross-section on a cylindrical surface centred on the fan rotation axis and intersecting the air moving section at a radius between the specified radius and the blade tip end.

It is also preferred for efficient air moving that the air moving section of each blade has a rounded leading edge and a sharp trailing edge over at least part of its along-blade length when seen in cross-section on a cylindrical surface centred on the fan rotation axis and intersecting the air moving section at a radius between the specified radius and the blade tip end.

The minimum height difference between each blade and its neighbouring blade when the blades are in their stowed positions may advantageously occur approximately where the blade overlies its neighbouring blade. If an overlying blade sags slightly, as may be the case with blades moulded from certain plastics if left unused for some time, this arrangement has been found to support the outer part of the blade reasonably well once contact between a blade and its underlying neighbour has been made.

The invention provides in another aspect a combined ceiling fan and light fitting having a plurality of elongate and arcuate planform blades that can move pivotally about upright axes between firstly stowed positions above a light fitting enclosure and secondly deployed positions in which the blades extend outwardly beyond the light fitting, characterized in that leading edges of the blades when in their deployed positions firstly rise with increasing radius beyond the light fitting enclosure first and thereafter are cranked downwardly.

In this aspect, when the blades are in their stowed positions each blade overlies a part of its neighbouring blade which part is received in a gap above the light fitting enclosure and below the underside of the overlying blade said gap existing by virtue of the cranked shape of the overlying blade.

Each blade may be pivotally mounted to a rotating platelike member with said gap lying above said platelike member.

In a third aspect the invention provides a combined ceiling fan and light fitting having air moving blades that in use exhibit gullwing dihedral. It is thought that such a dihedral form may be advantageous in itself even apart from its ability to enable compact stowage of retracting blades. "Gullwing dihedral" is to be taken as meaning that a lifting blade or wing rises between its root end and a point or region along its length toward its tip end and then either falls, remains level or rises more slowly.

In a further aspect the invention provides a combined ceiling fan and light fitting having a plurality of fan blades, wherein:

each blade is pivotally mounted so as to be pivotable about an upright pivot axis of the blade between a stowed position and a deployed position;

each blade when in its stowed position lies within a specified radius from an upright fan rotation axis and above a light fitting portion and has an air moving portion that in the deployed position of the blade extends beyond said specified radius; and each blade is generally elongate and arcuate when seen in plan view with concave and convex sides and in its stowed position extends peripherally within said specified radius between its pivot axis and a tip end of the blade, characterized in that:

(a) each blade when deployed is so positioned that a concave side of the blade faces forward in the blade's direction of rotation and so that a radially outer portion of the blade's length extends both outwardly and forwardly;

there is a first position partway along the air moving portion of the blade at which the blade's chord as measured in a peripheral direction has a maximum value and a second position partway along the air moving portion of the blade at which the blade has a maximum positive angle of incidence to the horizontal; and (c) the first position is at a greater radius than the second position.

That is, the distributions of incidence and chord disclosed herein are believed advantageous in themselves apart from the issue of blade stowage.

The invention further provides a blade adapted for use in fan/lights as disclosed.

It is explicitly intended that the specific four-blade embodiment described in detail below be taken to be a claimable aspect of the invention both as to the proportions of the blades and their relative positions when in their stowed and operating positions.

The invention is preferably applied in fan/lights having certain features of the construction described in International Patent Publication WO 2007/006096 (based on International Patent Application No. PCT/AU2006/000981 by Joe Villella).

In a still further aspect of the invention there is further provided a fan/light comprising a plurality of retractable fan blades, wherein:

each said blade is pivotally mounted to a fan member that is rotatable about an upright fan rotation axis so that said blade is pivotable between a retracted position and an operating position about an upright blade pivot axis of said fan member;

each said blade has an elongate and generally arcuate air moving blade portion that when said blade is in the retracted position of said blade lies within a space bounded by:

(a) an inner cylindrical surface coaxial with said fan rotation axis and touching an inner edge of said blade portion;

(b) an outer cylindrical surface coaxial with said fan rotation axis and touching an outer edge of said blade portion;

(c) a first radial plane containing said fan rotation axis and said blade pivot axis; and a second radial plane containing said fan rotation axis and that touches a tip of the blade, so that associated with every point on said blade portion is an angle theta being an angle between said first radial plane and a radial plane containing the fan rotation axis and that point; and within a continuous section of the blade portion that lies between said first and second radial planes, said inner edge increases in height above a datum height with increasing theta, and a radial projection of said inner edge onto a cylindrical surface coaxial with said fan rotation axis is concave downwards.

Preferably, within said continuous section of said blade said inner edge increases in height above said datum height with increasing theta until a maximum value of the inner edge height is first reached at a point thereon whose value of theta is less than the value of theta at the blade tip.

Within said continuous section and for theta values greater than the smallest value at which said inner edge has its maximum height above said datum height, the height of said inner edge may decrease with increasing theta. This particular embodiment corresponds to the preferred embodiment described in detail herein.

In such a fan/light the other preferred features proportions and relative positioning of the blades as described herein may also be applied, including as to the blade trailing edge shape.

Further features, preferences and inventive concepts are disclosed in the following detailed description and appended claims.

In this specification, including in the appended claims, the word "comprise" (and derivatives such as "comprising", "comprises" and "comprised") when used in relation to a set of integers, elements or steps is not to be taken as precluding the possibility that other integers elements or steps are present or able to be included.

BRIEF DESCRIPTION OF THE DRAWINGS

In order that the invention may be better understood there will now be described, non-limitingly, preferred embodiments of the invention as shown in the attached Figures, of which:

FIG. 13 is a graph of heights above a datum height of inner and outer edges of a blade of the fan/light shown in FIG. 1, as a function of circumferential position when the blade is in a refracted position;

FIG. 14 is a graph of radial distance between inner and outer edges of a blade of the fan/light shown in FIG. 1, as a function of circumferential position when the blade is in a retracted position;

FIG. 15 is a graph of heights above a datum height of inner and outer edges of all blades of the fan/light shown in FIG. 1, as a function of circumferential position when the blades are in their retracted positions;

FIG. 17 is a graph of an angle of incidence to the horizontal of the extended fan blade shown in FIG. 11 as a function of radial position on the blade; and FIG. 18 is a graph of the chord of the extended blade shown in FIG. 11 as a function of radial position on the blade.

DETAILED DESCRIPTION

Figure 1:
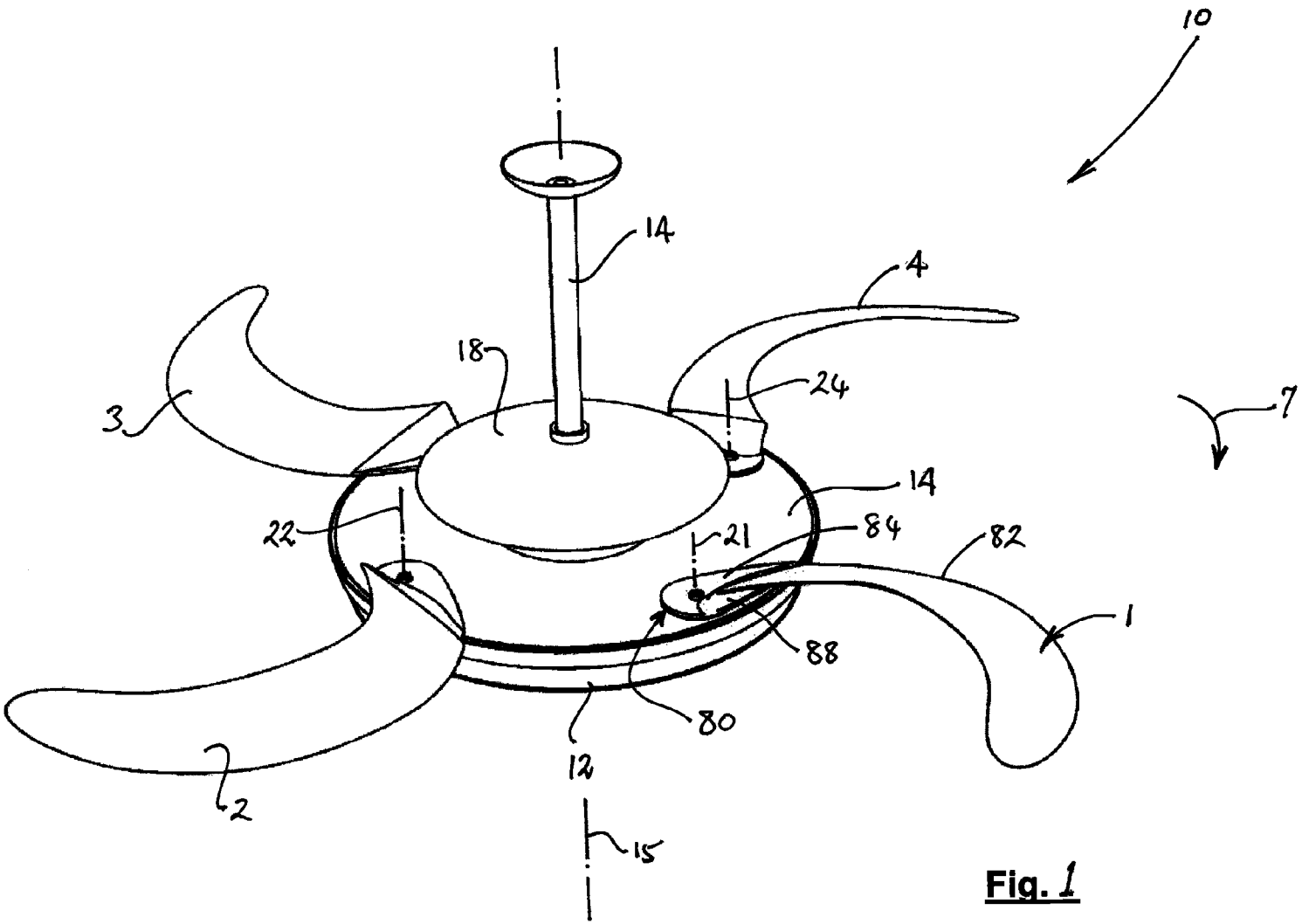
FIG. 1 is a perspective view from above of a fan/light with retractable fan blades according to the invention, shown with its blades deployed to their operating positions.
Figure 2:
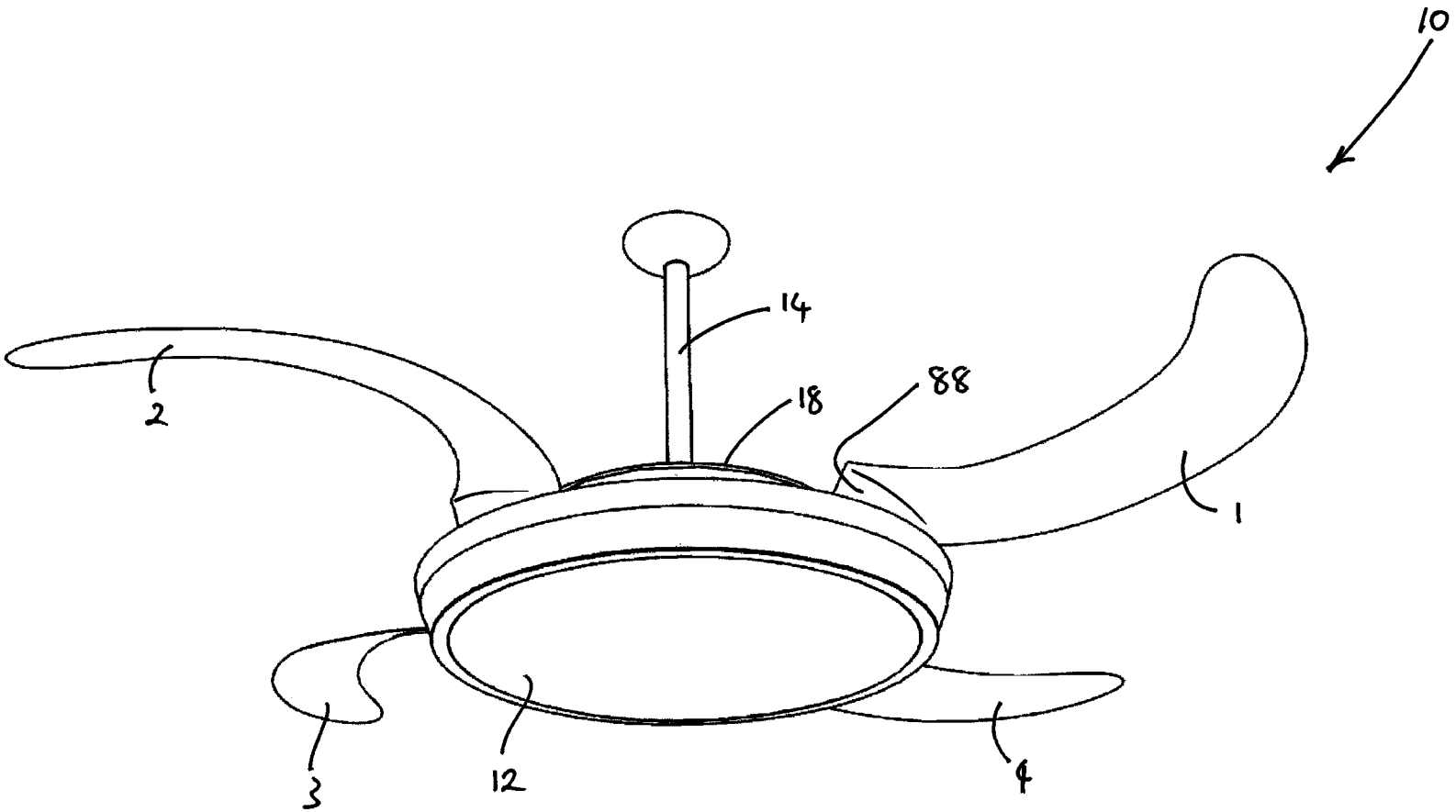
FIG. 2 is a perspective view from below of the fan/light shown in FIG. 1 with its blades deployed to their operating positions.
Figure 3:
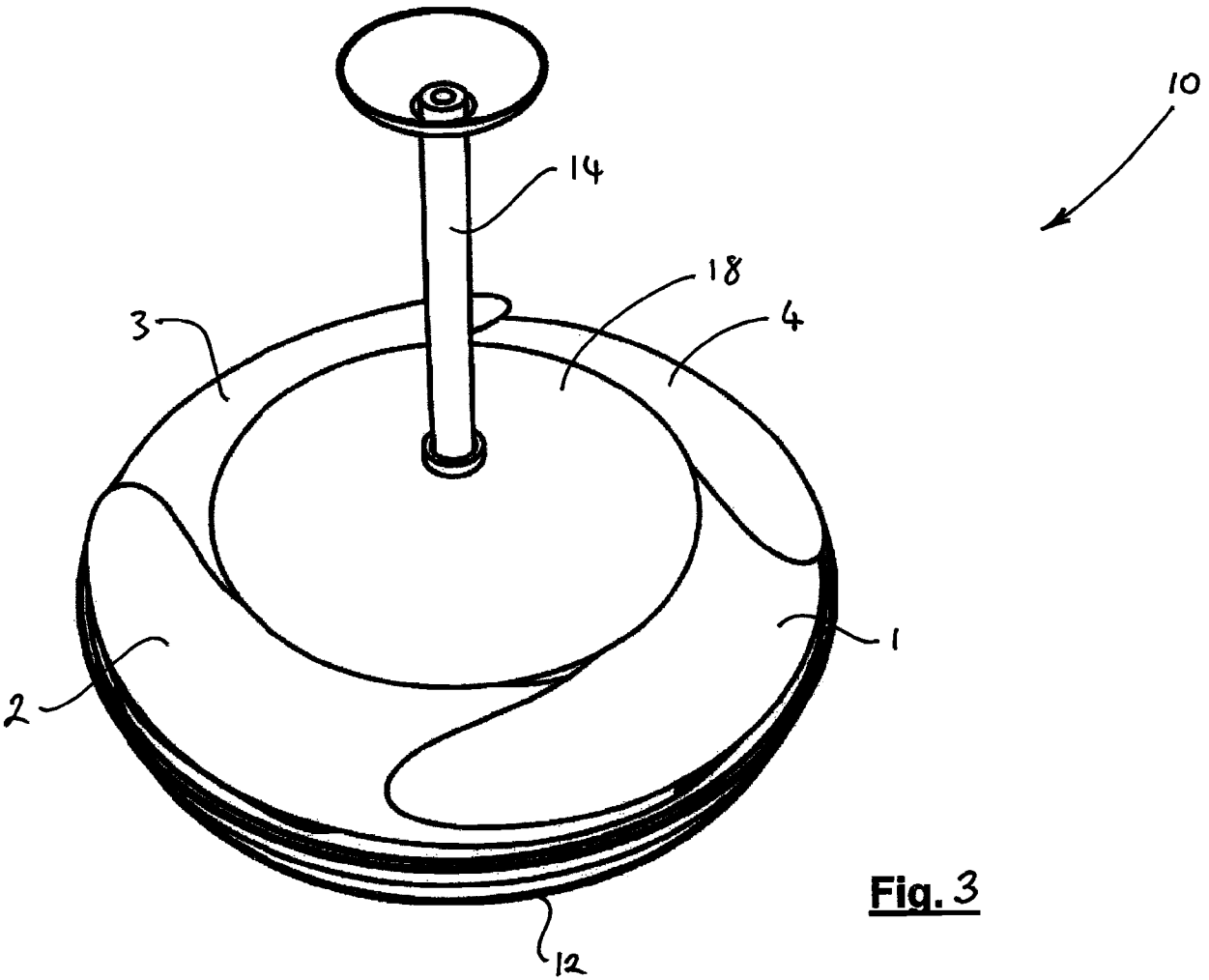
FIG. 3 is a perspective from above of the fan/light shown in FIG. 1, now with its fan blades shown in their folded, non-operating positions.
Figure 4:
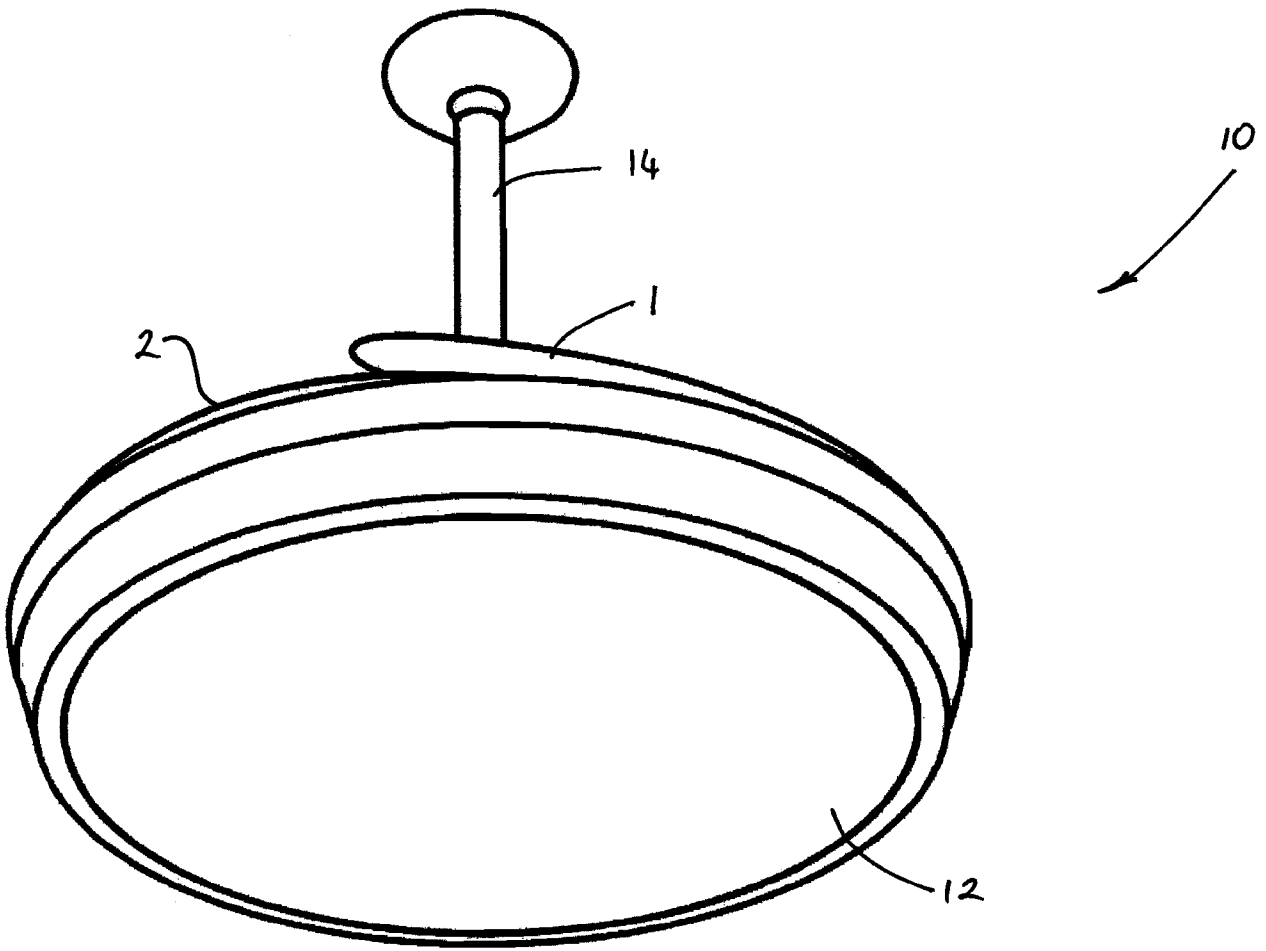
FIG. 4 is a perspective view from below of the fan/light shown in FIG. 1, with its fan blades shown in their folded, non-operating positions.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

FIGS. 1 to 8 show a fan/light 10 according to the invention. Fan/light 10 has a non-rotating bowl-like translucent enclosure 12 in which is mounted at least one electric lamp (not shown), and is supported from a ceiling by a tubular support 13 in known manner. Fan/light 10 also has fan blades 1, 2, 3 and 4 that are rotatable by an electric motor (not shown) about an upright axis 15 coaxial with tubular support 13. The electric motor and the lamp are operable separately or together from a source of electric power that is supplied through the tubular support 13. The motor is of a known type, widely used in ceiling fans, that has a rotating external casing (not shown) with a central cavity in which is received the tubular support 13. Enclosure 12 is circular in plan view, centered on axis 15.

Blades 1-4 each extend outwardly to the operating positions shown in FIGS. 1, 2, 5 and 7 when the motor is switched on, and retract (fold) into positions shown in FIGS. 3, 4, 6 and 8 when the motor is switched off. The sense of rotation is as shown by arrow 7. Each one of blades 1-4 is pivotally supported on a blade support plate 14 that supports and rotates with blades 1-4, is disc-shaped, is coaxial with the rotation axis 15 of the motor and is secured to the motor's casing. A decorative dust cover 18 is secured on the support 4 above the blades 1-4 when they are in the folded positions shown in FIGS. 3, 4, 6 and 8.

Pivoting of blades 1-4 on blade support plate 14 is respectively about axes 21, 22, 23 and 24 parallel to the axis 15 of rotation of the motor. When the motor is switched on, blades 1-4 pivot outwardly under the influence of centrifugal force, pivoting around their respective pivot axes 21-24, until the operating positions shown in FIGS. 1, 2, 5 and 7 are reached. When the motor is switched off, blades 1-4 are retracted to their stowed positions as shown in FIGS. 3, 4, 6 and 8, again pivoting about their respective axes 21-24.

In international patent No. publication WO 2007/006096 (based on International Patent Application No. PCT/AU2006/000981 by Villella), which is incorporated herein in its entirety by reference, there is described a fan/light generally in accordance with the above principles and arrangement, albeit with three blades instead of the four blades 1-4 of fan/light 10. The present invention in its preferred embodiment is made in accordance with the principles and arrangement set out in Villella's disclosure save for the use of the four blades 1-4 instead of three.

Figure 9:
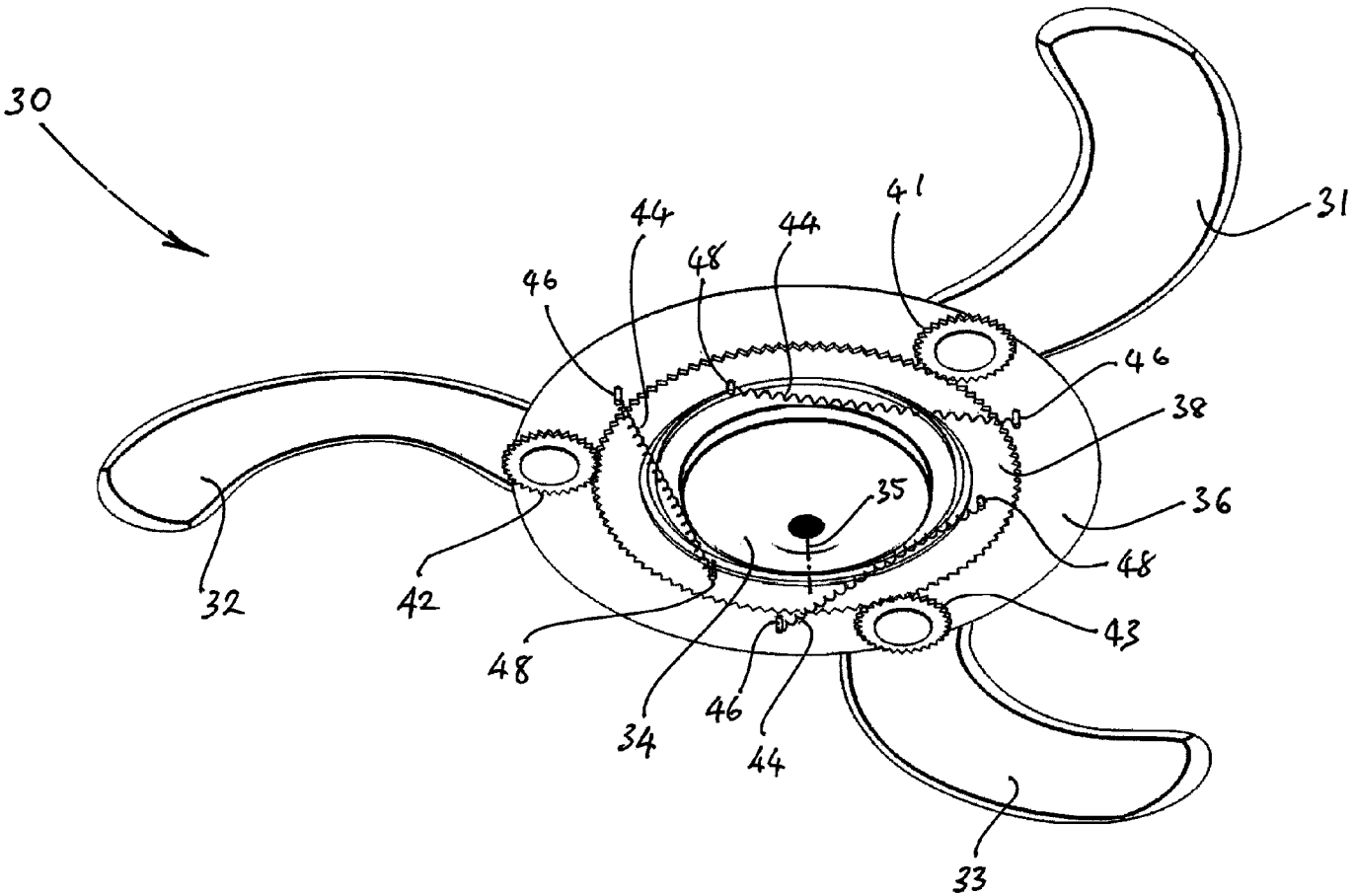
FIG. 9 is a perspective view from below of a subassembly of a fan/light with retractable fan blades described in International Patent Publication No. WO 2007/006096 by Villella.

In particular, synchronization of the pivoting movement of blades 1-4 and their refraction, may be by means of a simple adaptation to four blades of the approach disclosed by Villella, now briefly described. FIG. 9 (similar to FIG. 7 of Villella's publication) shows a subassembly 30 of Villella's fan/light comprising a motor 34, blade support plate 36 and three blades 31, 32 and 33. (Note: The item numbers used herein to describe subassembly 30 are not the same as those used in the cited Villella publication.) Blade support plate 36 is ring shaped and secured to motor 34 (of the rotating casing type previously mentioned) so as to rotate therewith in its own plane.

Secured below blade support plate 36 is a sun gear 38. (The term "sun gear" is here used as it is in the art of so-called planetary gearing systems, where it refers to a gear that meshes with a number of "planetary" gears arrayed around its periphery.) Sun gear 38 is coaxial with the motor 34 when support plate 36 is mounted to motor 34, and is able to rotate about its axis relative to support plate 36. Meshing with sun gear 38 are planetary gears 41, 42 and 43, each of which rotates as its associated one of blades 31-33 pivots between its stowed and operating positions. Each of gears 41-43 is secured to a short shaft (not visible) that passes downwardly from its associated one of blades 31-33 and can rotate within support plate 36. The gears 41-43 are equispaced around the periphery of sun gear 38 and are themselves all at the same radius as each other from the rotation axis 35 of motor 34. The effect of this arrangement is that provided blades 31-33 are identical and identically positioned in their working positions relative to support plate 36, they will be kept synchronized always when they pivot between their operating and retracted positions.

To retract blades 31-33 when motor 34 is switched off, coil springs 44 are provided. One end of each spring is secured to a formation 46 depending from support plate 36 and the other end is secured to a formation 48 depending from sun gear 38. Coil springs 44 are arranged to be in tension when blades 31-33 are in their retracted position and are extended as centrifugal force urges blades 31-33 out when motor 34 is started. When motor 34 is stopped, springs 44 urge sun gear 38 to rotate relative to support plate 34 so as to retract the blades 31-33.

For further information on, and options relating to, this arrangement for blade synchronization and retraction, refer can be made to the cited publication of Villella.

The way to adapt this arrangement to the four blades 1-4 of the embodiment of the present invention here described will be readily apparent to persons skilled in the art. There would be provided four planetary gears (not shown, but equivalent to gears 41-43) instead of three, equispaced around the sun gear (not shown, but equivalent to sun gear 38) and each associated with one blade.

In the following description, it will be assumed that blades 1-4 are pivotally mounted to support plate 14 essentially similar to support plate 36 and synchronized and refracted in the same way as blades 31-33 of subassembly 30. However, it is emphasized that the aerodynamic design of blades 1-4 and the way that they "nest" together when refracted are by no means limited to this particular fan/light construction. The configuration and arrangement of blades 1-4 could be applied to fan/lights of other constructions and to fans requiring retractable blades and without any lighting capability.

The blades 1-4 and their arrangement in fan/light 10 will now be described. Blades 1-4 are intended to provide fan/light 10 with a useful balance between satisfactory air-moving performance, compactness when the blades are in their stowed (i.e. refracted or folded) position, together with a diameter of the translucent enclosure 12 that is large enough to provide a reasonably diffuse lighting effect. The blades 1-4 are intended to lie substantially above the translucent enclosure 12 when retracted. In the embodiment shown and described herein, the enclosure 12 has a diameter that is about 39% of the overall diameter of fan/light 10 with its blades 1-4 extended for operation. The diameter of the hub of a conventional ceiling fan or fan/light without retractable blades is typically smaller than 39% of the overall diameter over the blades. The larger the diameter of enclosure 12 for a given overall diameter, the easier it is to meet the requirement of compact folding, with blades 1-4 above enclosure 12, but the more difficult it is to provide satisfactory air moving performance at normal fan rotational speeds. A range of from about 36% to about 42% for the above ratio is believed to be possible by straightforward adaptation of the blade shapes as described herein, but a figure in the region of 38% to 40% is preferred.

The geometry of blades 1-4 will be described below by reference to quantities and sections defined in FIGS. 10 and 11. In the schematic plan view of FIG. 10, enclosure 12 is represented simply by its circular outer peripheral edge 26. Blades 1-4 are all shown in outline in their retracted positions, blade 1 in solid lines and the others in chain-dotted lines, and blade 1 is also shown in solid lines in its deployed position. Blades 1-4 are substantially identical to each other and are generally scimitar-shaped, i.e. of arcuate form so as to lie, when retracted, within the enclosure peripheral edge 26 and around the motor (not shown but centred on axis 15). The pivot axes 21-24 are adjacent to root ends 51-54 respectively (FIG. 11) of blades 1-4 and in their refracted position the blades 1-4 extend clockwise to tips (free ends) 61-64 respectively. Item numbers with the postscript "a" are for blade 1 in its deployed position and item numbers with the postscript "b" are for blade 1 in its retracted position.

Blades 1-4 of fan/light 10 are shown (by arrow 7) as rotating clockwise when seen from above. It is to be understood however, that counter-clockwise rotation could equally well be chosen, in which case the term "counter-clockwise" would be applicable where in the present description "clockwise" now appears, including in the definitions given below of the terms "next blade" and "previous blade". (Note that for counter-clockwise rotation, the blades would be made of opposite hand to blades 1-4, as it is preferred that each blade's leading edge be its concave one.)

In relation to any given one of blades 1-4, the term "next blade" refers to the blade whose pivot axis is 90 degrees in the rotation direction (here clockwise) from the pivot axis of the given blade, and the term "previous blade" refers to the blade whose pivot axis is 90 degrees in a counter-direction opposite to the rotation direction (i.e. counter-clockwise here) from the pivot axis of the given blade. Thus, in relation to blade 1, the next blade is blade 2 and the previous blade is blade 4. The blade shape will be described mainly by reference to blade 1 for convenience, noting that blades 1-4 are substantially identical.

To show how blades 1-4 are arranged relative to each other in nesting fashion when refracted, it will be convenient to use sectional views on radial planes, i.e. planes that include the fan axis 15. Such a plane 42 is shown in FIG. 10 and is shown to be at an angle θ (theta) to a similar plane 44 that includes both axis 15 and axis 21 of blade 1.

For discussion of the blade shape from the point of view of aerodynamic characteristics when in the deployed position, it will be useful to consider blade sections taken on surfaces that are cylindrical, coaxial with fan axis 15, and located at stations radially spaced apart along a blade. Arcs numbered 1 to 8 in FIG. 11 indicate such stations on blade 1. Stations 1 and 8 are respectively at radii of 39% and 97% of the overall fan radius (i.e. substantially at the edge of enclosure 12) with stations 2-7 radially equispaced between stations 1 and 8.

Each of blades 1-4 pivots through 180 degrees between its retracted and operating positions. From axis 21 to tip 61, representative blade 1 when retracted extends from theta=0 degrees to theta=approximately 168 degrees. The angle 168 degrees is chosen to be close to, but below, 180 degrees so as to provide a blade 1 whose tip 61 is well clear of enclosure peripheral edge 26 when blade 1 is deployed, but with no more than two of blades 1-4 overlapping each other at any point when the blades are retracted. This is important in keeping the overall height of the group of blades 1-4, when retracted, to a compactly small value. Note that if tip 61 where at theta=180 degrees, all three of blades 1, 2 and 3 would overlap at theta=180 degrees.

Figure 5:
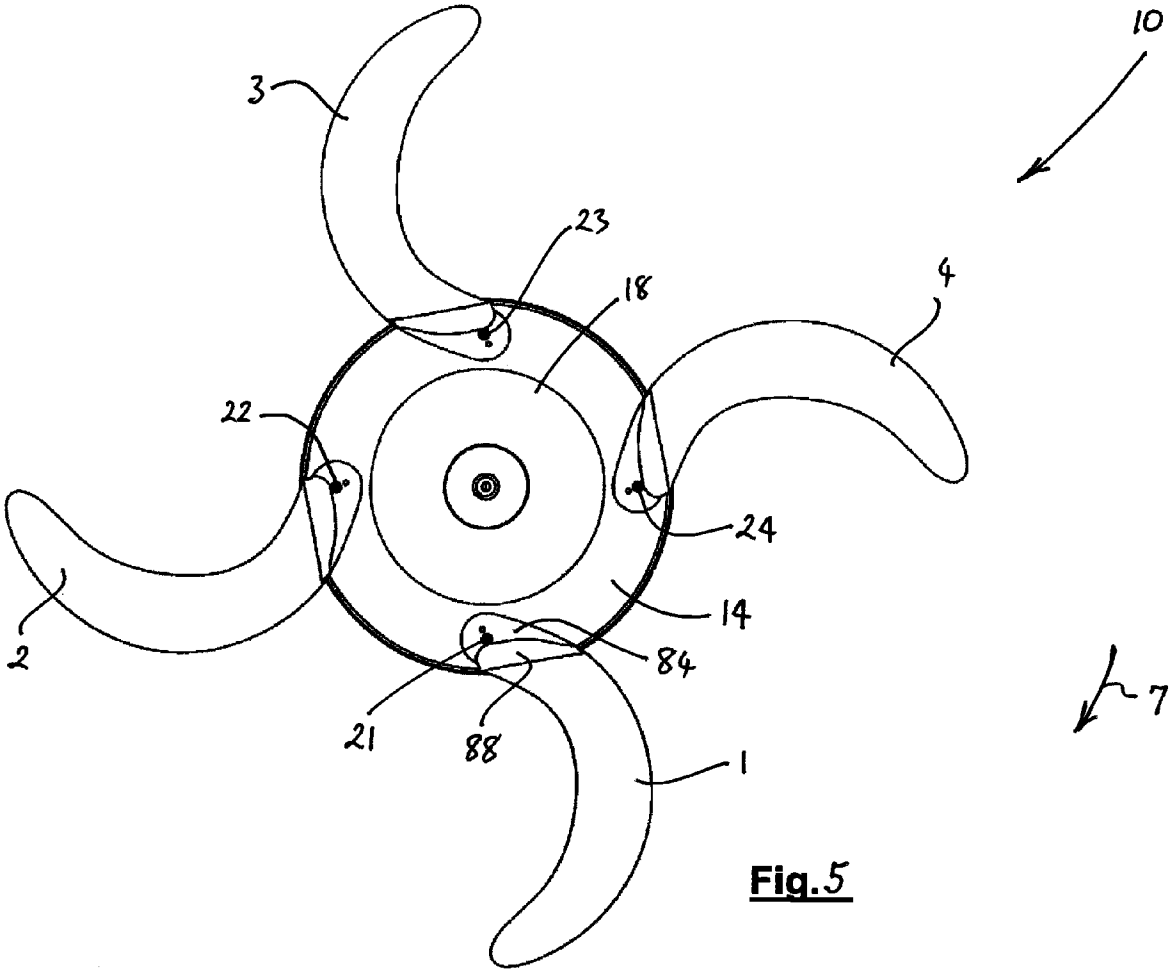
FIG. 5 is a plan view of the fan/light of FIG. 1, with its fan blades shown deployed to their operating positions.
Figure 6:
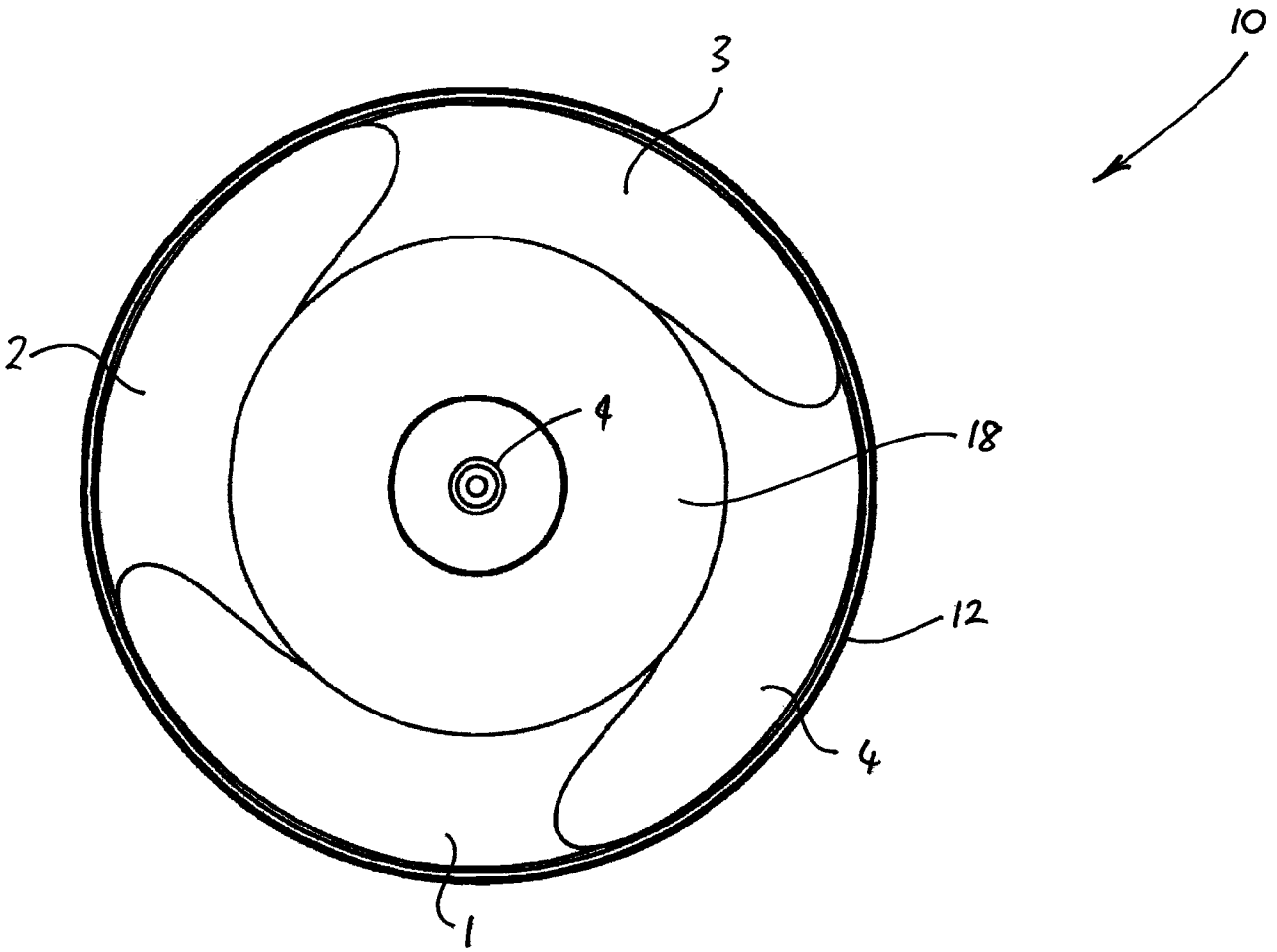
FIG. 6 is a plan view of the fan/light of FIG. 1, with its fan blades shown in their folded, non-operating positions.
Figure 7:
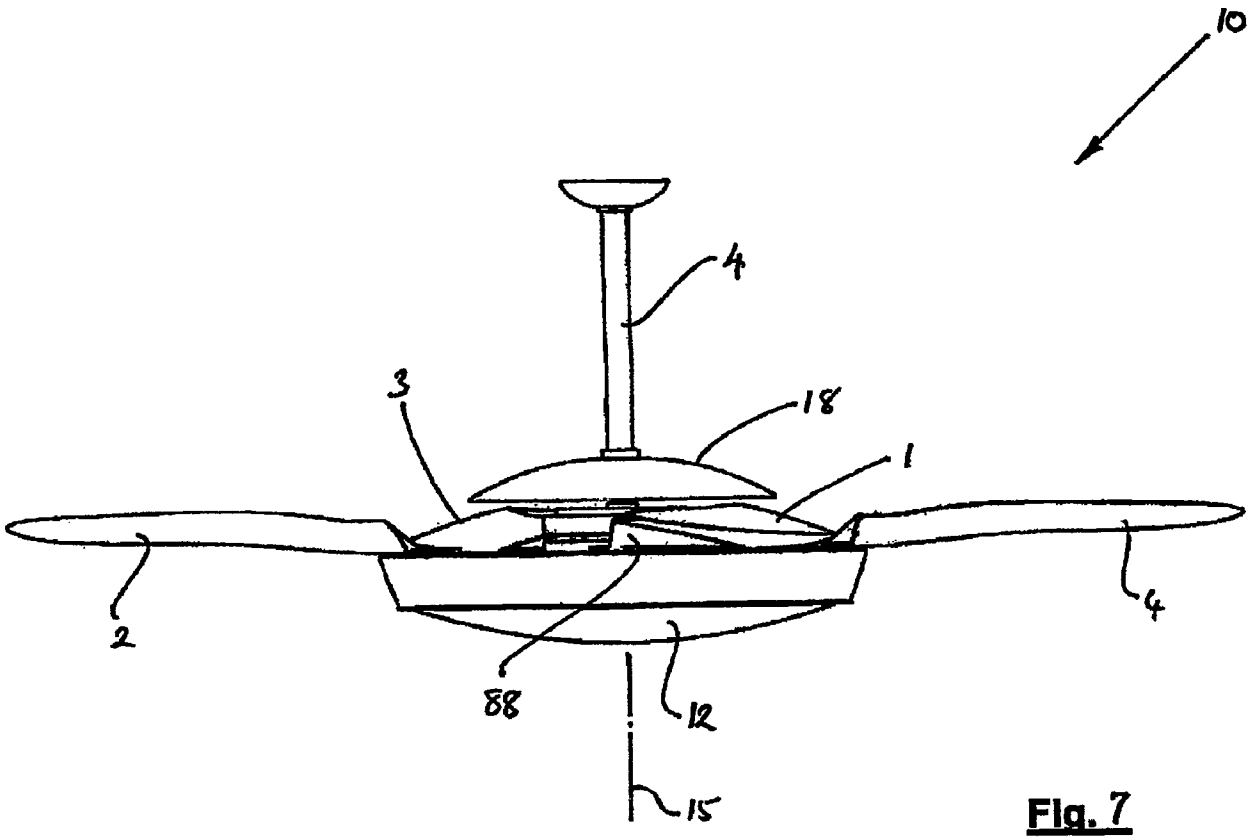
FIG. 7 is a side view of the fan/light of FIG. 1, with its fan blades shown deployed to their operating positions.
Figure 8:
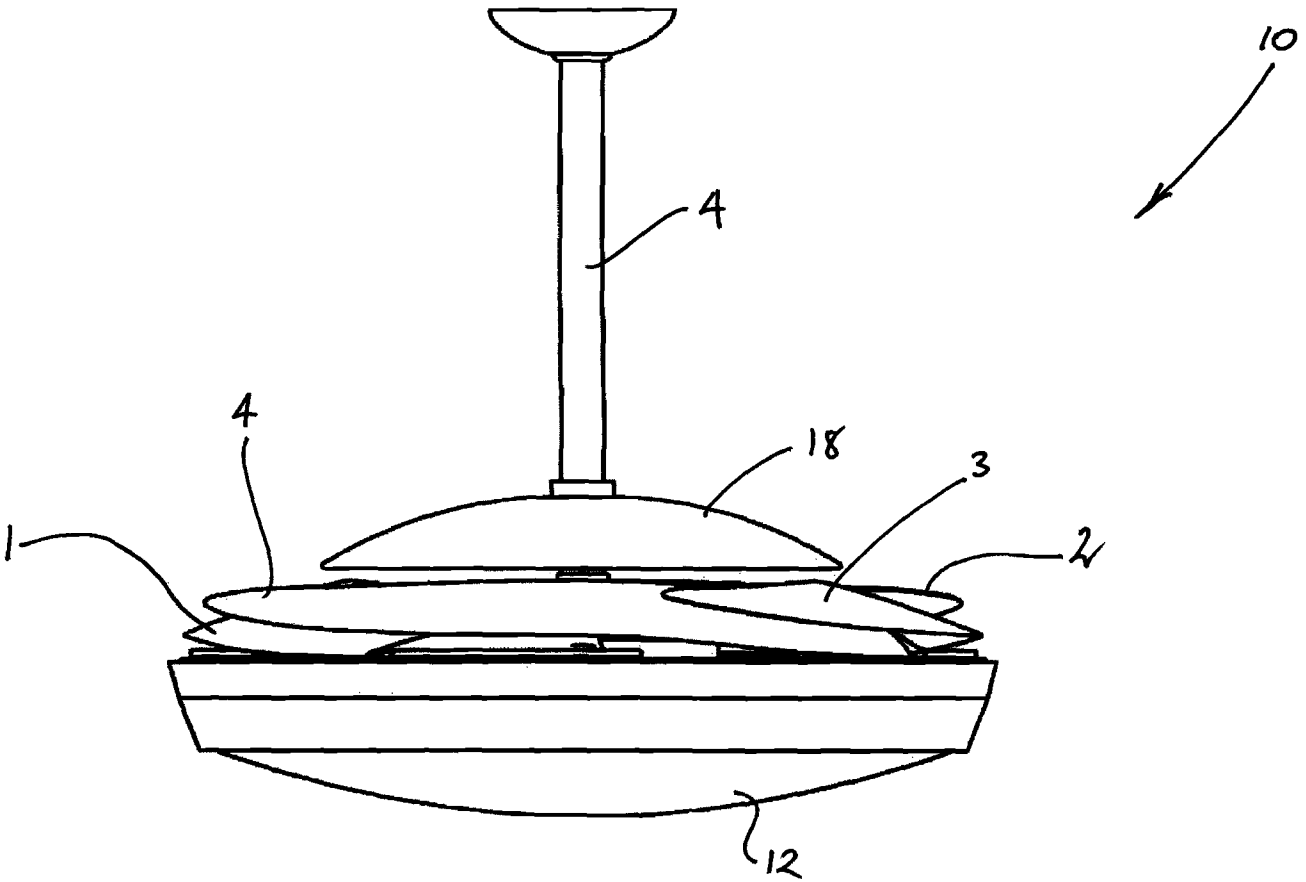
FIG. 8 is a side view of the fan/light of FIG. 1, with its fan blades shown in their folded, non-operating positions.

As can be seen in FIGS. 1, 5 and 7, representative blade 1 has two distinct portions, namely a root-end portion 80 and a blade portion 82 which in the operating position extends outwardly of peripheral edge 26 of enclosure 12 and is aerodynamically shaped to facilitate air movement. Blade portion 82 is supported cantilever-fashion from blade portion 80 which is pivotably secured to blade support plate 14. In the preferred embodiment, portions 80 and 82 are formed as a single part, for example by injection molding in a suitable plastics material.

Root end portion 80 comprises a plate 84 that lies above and, approximately parallel to support plate upper surface 46. A hole 86 in plate 84 permits a stub shaft (not shown) to pass through it and through to the underside of support plate 14 to be secured there to a planet gear (not shown) of the blade synchronization mechanism as described previously. Root end portion 80 further comprises a blade end plate formation 88 whose function is to provide a suitably strong connection between portions 80 and 82 with blade portion 82 inclined at an angle of incidence to plate 84 (see below).

Figure 12A:
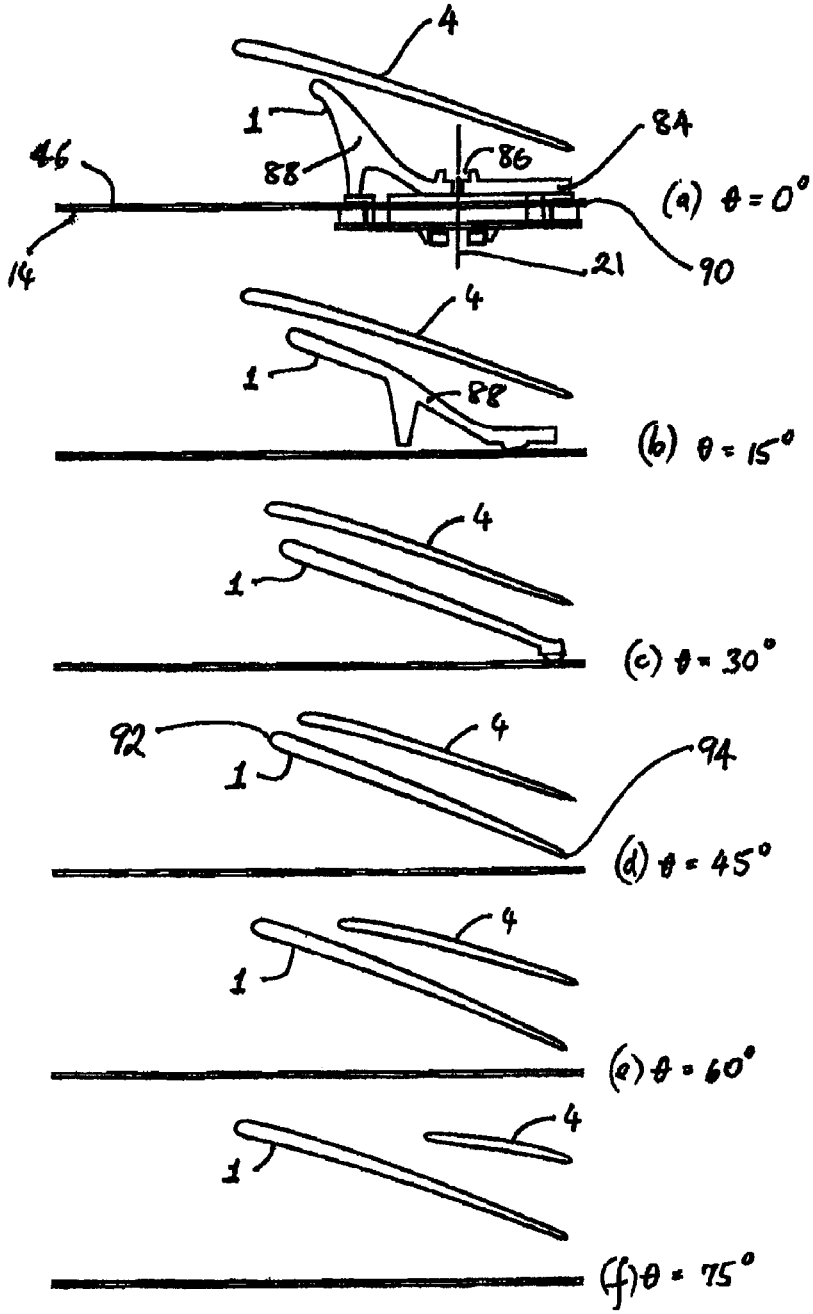
FIG. 12 is a set of sections (labeled a-l) on radial planes as defined in FIG. 10 of refracted blades of the fan/light shown schematically in FIG. 10.
Figure 12B:
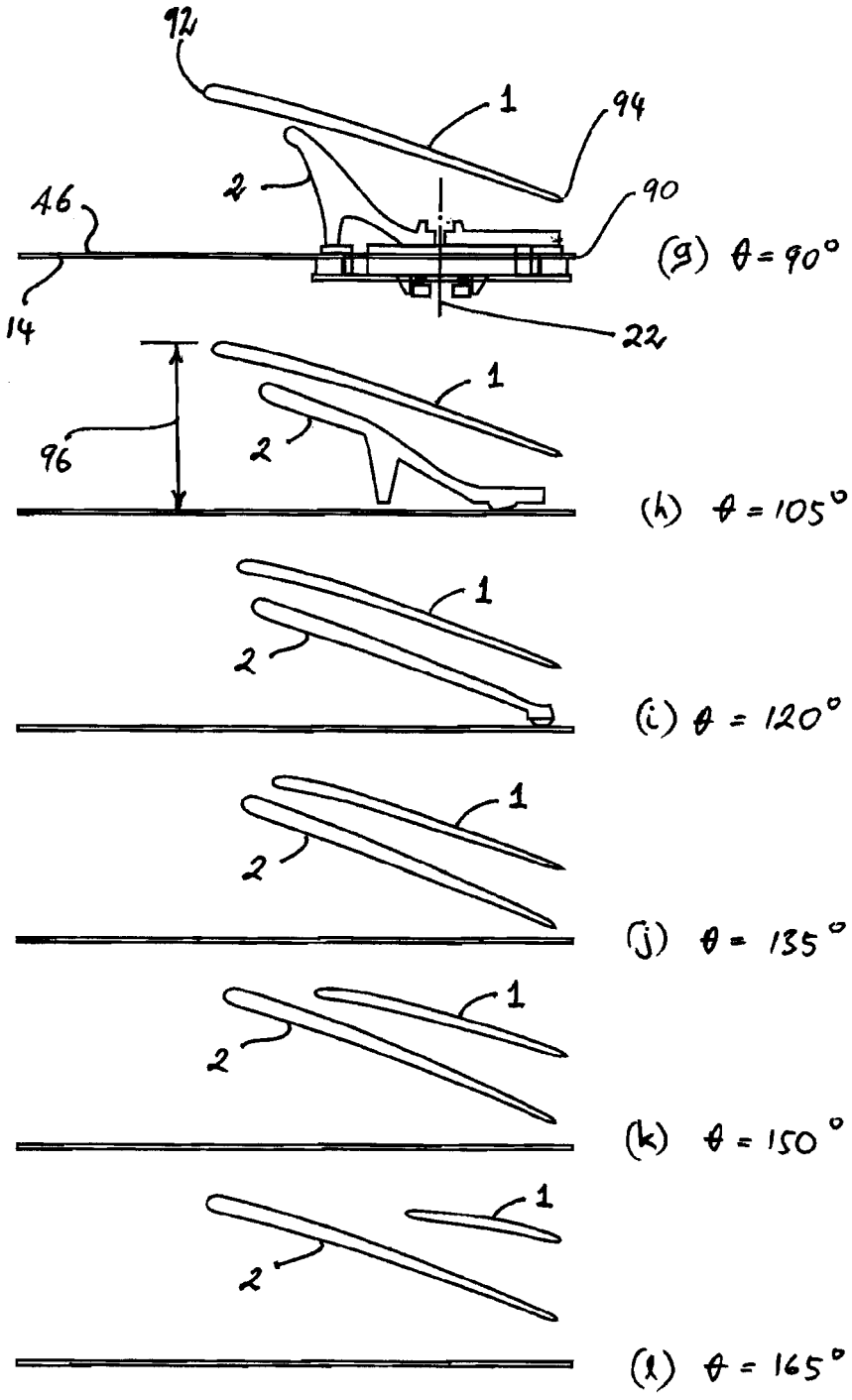

FIG. 12 shows a set of 12 radial sections (i.e. on planes 42) of representative blade 1 and its next and previous blades 2 and 4 in their retracted positions, each section being labeled with its correct value of theta for blade 1. Radii from fan axis 15 increase to the right in sections (a) to (l). In each section, blade support plate 14 is shown, with its outer edge 90 at the same lateral position on each page to facilitate comparison between the sections. Outer edge 90 lies radially just within but is close to the enclosure peripheral edge 26 (not shown in FIG. 12).

Sections (a) to (c) of FIG. 12 show how portion 80 of blade 1 transitions to the cantilevered air-moving portion 82.

Figure 10:
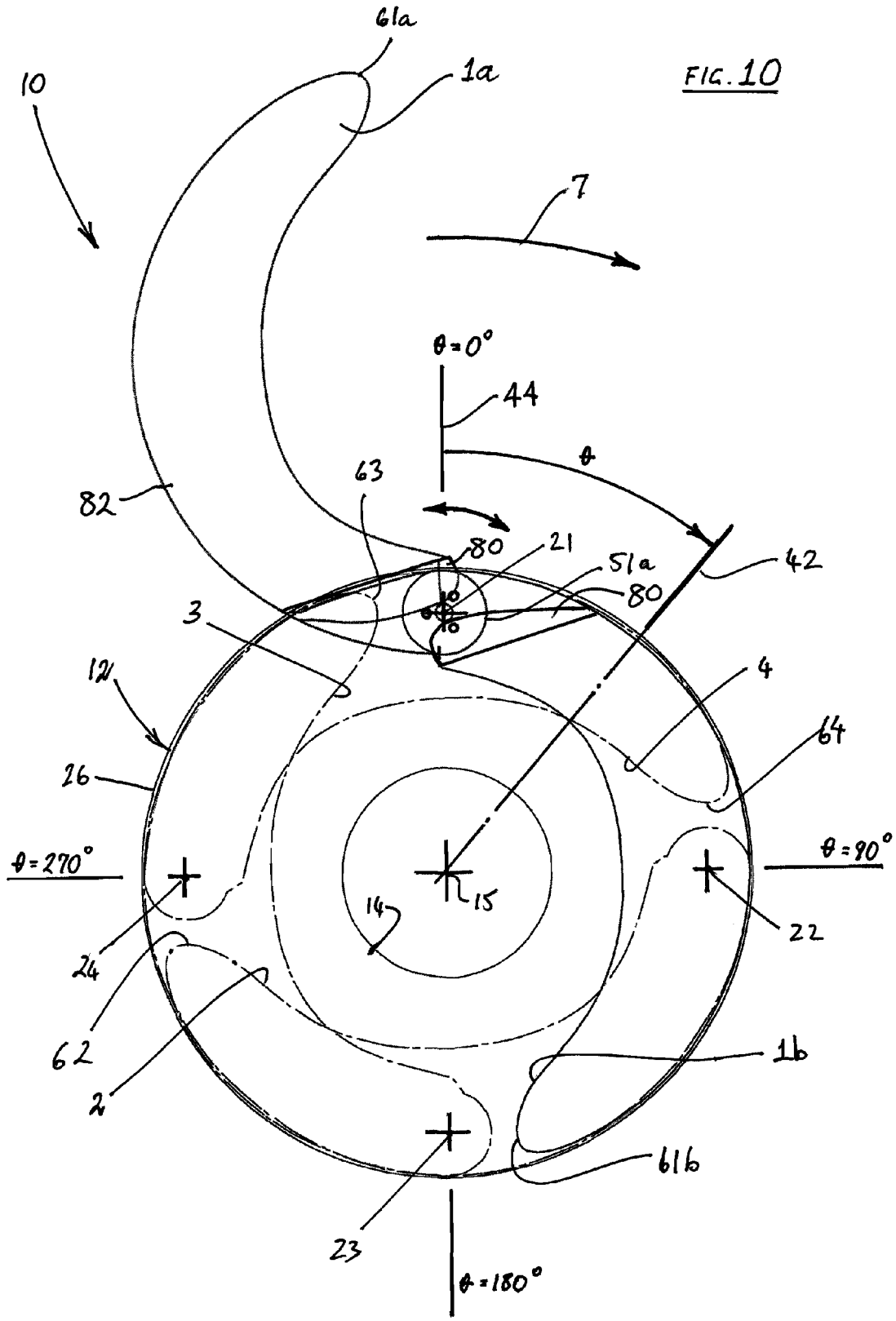
FIG. 10 is a schematic plan view of the fan/light shown in FIG. 1 showing one blade in both deployed and retracted positions and the other blades in retracted positions and chain-dotted lines only.
Figure 11:
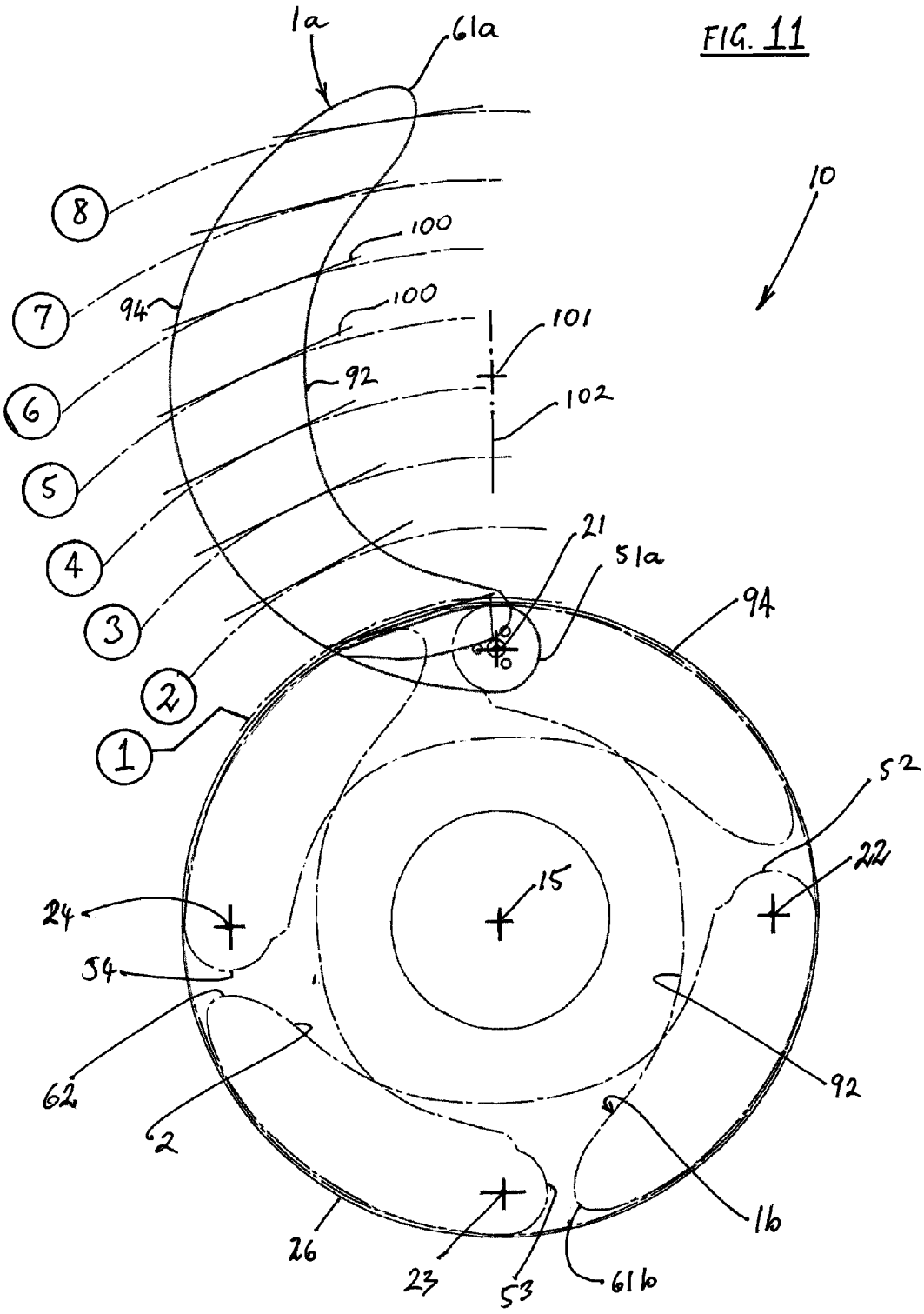
FIG. 11 is a schematic plan view of the fan/light shown in FIG. 1 with all blades shown in chain-dotted lines in retracted positions and one blade also shown in its deployed position the view further showing positions of a set of cylindrical surfaces intersecting, and located at radially spaced stations along, the extended blade.

As can be best seen in FIG. 10, outer edge 94 of portion 82 of representative blade 1 is very close to a circular arc except near the rounded tip 61, that arc being centred on fan axis 15 when blade 1 is retracted and having a radius very close to the radius of enclosure peripheral edge 26. Accordingly outer edge 94 of portion 82 of blade 1 lies at almost exactly the same radius as the outer edges of next and previous blades 2 and 4, except near tip 61, as shown in sections (d) to (l) of FIG. 12.

Sections (a) to (f) of FIG. 12 show that previous blade 4 overlies representative blade 1 between theta=0 degrees and slightly less than theta=90 degrees, but without contact between blades 1 and 4. Between theta=90 degrees and theta=165 degrees (sections (g) to (l)) blade 1 itself overlies next blade 2, without contact between blades 1 and 2.

FIG. 13 is a graph showing the heights of inner edge 92 and outer edge 94 of representative blade 1 above surface 46 of support plate 14 as a function of angle theta Inner edge 92 is higher than outer edge 94 for a given value of theta, consistently with blade 1 having an angle of incidence to the horizontal so as to move air downward when deployed (see below). Absolute height figures are used in FIG. 13, for a fan/light 10 having an overall swept diameter with blades 1-4 deployed of 1200 mm.

FIG. 14 is a graph showing the radial distance between inner edge 92 and outer edge 94 of representative blade 1 when in its retracted position as a function of angle theta. Absolute radial distances are used in FIG. 13, for a fan/light 10 having an overall swept diameter with blades 1-4 deployed of 1200 mm. The curve between data points has not been extended to the data point for theta=165 degrees because that point is affected by rounding of tip 61.

FIG. 15 is a graph showing the same data as FIG. 13, but now for all of blades 1-4, in their respective peripheral angle (theta) positions. The initials "LE" and "TE" are used for inner and outer edges 92 and 94 respectively in FIG. 15, because the inner edge of a blade is its leading edge and the outer edge is its trailing edge, when in the deployed position. Note that the blade pivot axes 21, 22, 23 and 24 are at angles theta of 0 degrees, 90 degrees, 180 degrees and 270 degrees, respectively.

FIG. 12-15 together illustrate how blades 1-4 in their retracted positions "nest" compactly together without any two blades contacting each other. It has been found that the arrangement shown can also give satisfactory air moving performance.

As illustrated by the edge heights in FIGS. 13 and 15, representative blade 1 rises smoothly from its pivot axis 21 (at theta=0 degrees) to a point (at about theta=90 degrees) where it must overlap and clear the next blade 2. However, instead of continuing further upward at the same rate towards its tip 61, blade 1 ceases to rise any higher, as shown by the leveling off and then decreasing of the height of inner edge 92 with increasing theta. This arrangement limits the overall height 96 (FIG. 12) above support plate 14 of the group of blades 1-4 when retracted. The maximum value of height 96 occurs for representative blade 1 at about theta=105 degrees.

It will be noted in FIGS. 13 and 15 that, after remaining approximately constant between about theta=90 degrees and theta=120 degrees, outer edge height 94 increases again beyond about theta=120 degrees. As can be seen from sections (j) to (l) in FIG. 12, and from the slight protrusion of blade 1 shown in FIG. 4, this optional feature means that some slight sacrifice of compactness in the blade nesting arrangement is incurred (although without any increase in overall height 96), it is believed to be aerodynamically desirable, as set out later herein, and so is preferred.

FIG. 13 can be interpreted as a partial picture of blade 1 as it would appear if projected on an imaginary cylindrical surface coaxial with fan axis, with that surface then being laid flat. It is apparent that blade 1 in such a picture resembles a gull wing, or an aircraft wing with a particular form of varying dihedral, firstly rising with increasing distance from its root end and from a certain point rising no further or at a lesser rate towards its tip end.

FIG. 15 shows that the inner edge height 92 of representative blade 1 becomes lower than the leading edge height of its next blade 2 for values of theta greater than about 150 degrees. This can be seen in sections (k) and (l) of FIG. 12. It does not mean that there is contact between blades 1 and 2 because the reduction in radial width of blade 1 means that inner edge 92 of blade 1 is radially outward of the corresponding edge of blade 2.

In addition to folding neatly, the blades 1-4 must move air downwards reasonably efficiently when deployed and rotating about fan axis 15, so the shapes of blades 1-4 as they affect air movement will now be discussed. The arcs in FIG. 11 that are numbered 1-8 represent a set of spaced apart cylindrical surfaces coaxial with axis 15 and radially spaced apart. Although the downward air flow through fan/light 10 will not in general be precisely axial (i.e. parallel to axis 15) and therefore occur on such surfaces, a reasonable way to discuss blade shape is by reference to the intersections with the cylindrical surfaces 1-8 of representative blade 1 when in its deployed position.

It is also helpful in the following discussion of the representative blade 1 when it is deployed to make mention of values of the angle theta that was used above in describing its geometry when retracted. Theta is in effect a measure of position along the scimitar-shaped blade 1. In FIG. 11, there is shown a non-physical point 101 that if blade 1 were to be retracted would fall on axis 15, and that when blade 1 is deployed is displaced by 180 degrees from axis 15 about the blade pivot axis 21. The value of angle theta corresponding to a particular feature on deployed blade 1 can be found using the schematic plan view of FIG. 11 by constructing firstly a line joining point 101 to the feature in question and secondly a line 102 joining point 101 and passing through axes 21, 15 and 23. Theta is the angle between these two lines.

Figure 16:
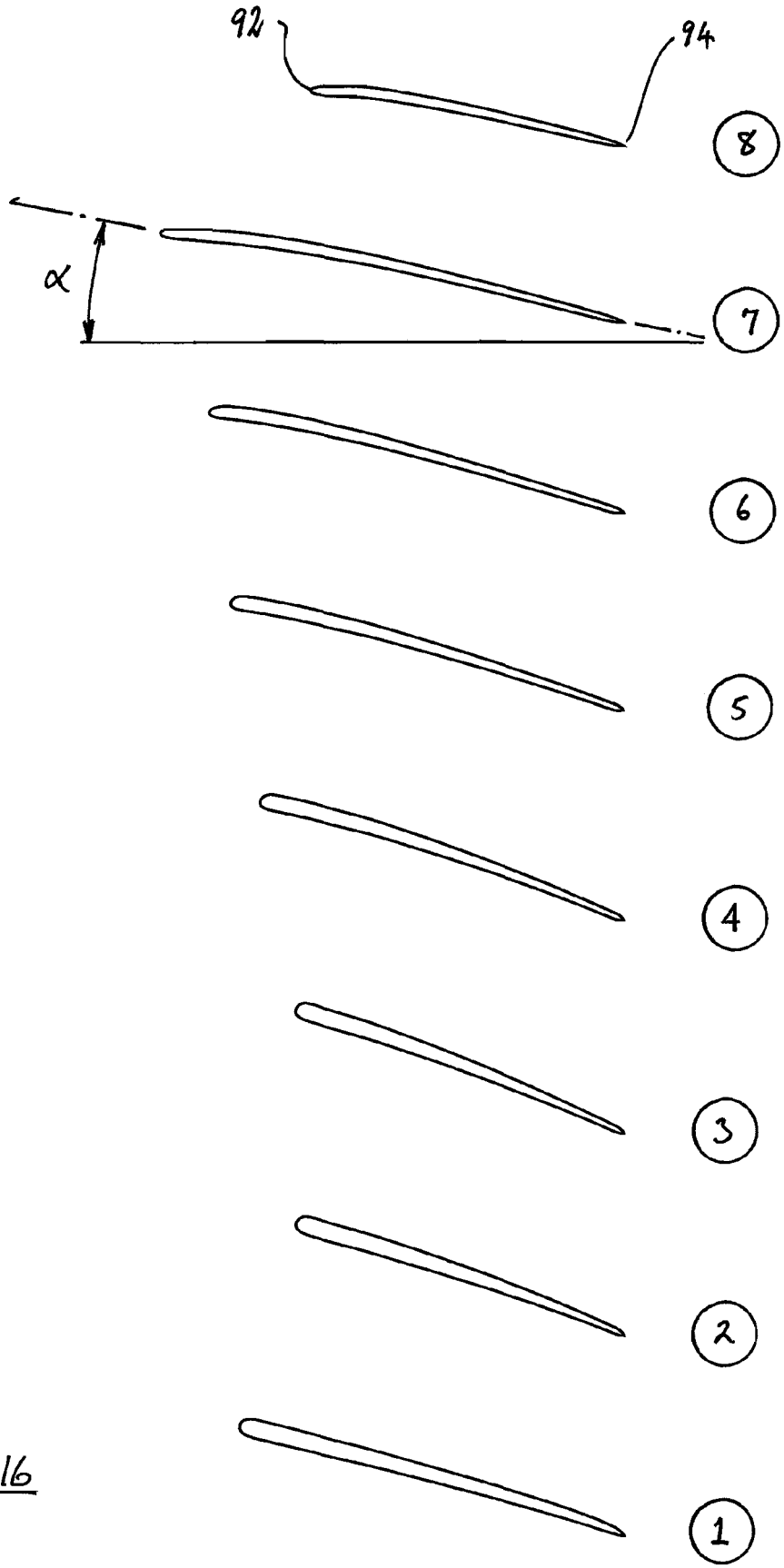
FIG. 16 is a set of cross-sections of the extended blade shown in FIG. 11 taken on planes tangential to the arcs shown therein an numbered 1 to 8.

FIG. 16 shows cross sectional views of blade 1 taken on chords 100 (see FIG. 10) that are tangent to the cylindrical surfaces of stations 1 to 8. These are close approximations to the shapes of the cylindrical surfaces of intersection between stations 1 to 8 and blade 1, as those surfaces would appear if laid flat. In the sections of FIG. 16, blade 1 moves right to left, so the leading edge 92 and trailing edge 94 are positioned as shown. Although trailing edge 94 is of course not straight in reality, the views in FIG. 16 are so positioned that the trailing edge 94 in all sections is vertically aligned to facilitate comparisons among them.

FIG. 17 is a graph showing alpha ($\alpha$), the angle of incidence to the horizontal of representative blade 1 at stations 2 to 8, the meaning of alpha being illustrated in the section for station 7 in FIG. 16. The values of alpha plotted in FIG. 17 are not taken from the approximate sections of FIG. 16, but are estimates of the values that would be obtained in the manner shown if the sections of FIG. 16 were laid-flat developments of the true surfaces of intersection between the cylindrical surfaces numbered 2 to 8 and blade 1.

FIG. 18 is a graph showing values of the true chord (i.e. distance measured directly from leading edge 92 to trailing edge 94) of blade 1 at intersections with the cylindrical surfaces numbered 1 to 8. The chord values are not taken from the approximate sections of FIG. 16, but are estimates of the values that would be obtained if the true surfaces of intersection between blade 1 and the cylindrical surfaces numbered 1 to 8 were obtained and laid flat.

It has been found that fan/light 10 with blades 1-4 having the geometry shown does move air reasonably satisfactorily despite the comparatively large ratio of the diameter of enclosure 12 to the overall diameter swept by the deployed blades 1-4 and the scimitar-like shape (in plan view) of the blades.

Generally, the blades 1-4 thrust air downward (and themselves experience a corresponding reactive lifting force) as they rotate. The effectiveness of a blade in this (for a given speed of rotation) is believed to be dependent on, at least, its aerofoil-type cross sectional shape, its incidence to the horizontal, its size (for example its chord as measured from leading edge to trailing edge), the distribution of these along the blade's length (span) and its shape as seen in plan view.

As seen in the cross-sections of representative blade 1 in FIG. 16, blades 1-4 have an aerofoil-type cross-sectional shape, being cambered so that their lower faces are concave and their upper faces are convex. Their leading edges (eg leading edge 92 of representative blade 1) are rounded and their trailing edges (eg edge 94 of representative blade 1) are sharp. Generally, blades 1-4 are preferred to have cambered aerofoil sections.

Representative blade 1 has positive incidence to the horizontal (and is of cambered aerofoil cross-section) near its pivot end where, when deployed, it crosses the enclosure peripheral edge 26, and this is believed to be one factor in its air-moving performance. This positive incidence (alpha greater than zero) is apparent in the section numbered 1 in FIG. 16.

It is thought desirable that the lift distribution (and the consequent distribution of air moving effect) along the length of a blade should be generally smoothly varying and in particular that there should be no strong concentration of the effect close to the outer (tip) end. Such a concentration is thought to produce a tendency for high pressure air below the tip area to "leak" upward over the tip end (61 in representative blade 1) to the area above the tip area, merely agitating the air locally (and wasting power) rather than moving it bodily downward. Therefore, the distribution of incidence angle alpha shown in FIG. 17 shows that the peak blade incidence of about 20 degrees is at about the radius of station 3 (see FIG. 11) and smoothly decreases with increasing radius to about 10 degrees at station 8. (Station 3 corresponds very approximately to theta=60 degrees.)

The incidence distribution shown in FIG. 17 is due in part to the optional upsweeping of the blade trailing edge beyond about theta=120 degrees that was discussed above. Although a slightly more compact nesting of blades 1-4 is achievable if this upsweeping is not incorporated, it does appear to be beneficial to the blades' performance due to its effect on the incidence distribution achieved.

A further way to influence the lift distribution along the blade is by control of its width (chord) distribution. If one imagines a scimitar shaped blade of constant width along its length (for example for all values of the theta) deployed in the way shown for blades 1-4 in FIG. 11, an effect of the scimitar shape would be that the blade chord, as measured in the circumferential direction with the blade deployed, would be highest at the blade tip and root end and lower therebetween. To offset this effect and so limit the tendency to concentrate the lifting effect at the tip and root ends, blades 1-4 are not of constant width. Referring to FIG. 14, the blade width as seen in plan view) is greatest at about theta=90 degrees and progressively reduces towards the tip end (61 for representative blade 1). As can be seen in FIG. 11, theta=90 degrees corresponds approximately to station 5. This reduction serves the dual purposes of compact nesting of the blades when retracted (as discussed above) and obtaining the desired blade lift distribution.

FIG. 18 shows the blade chord increasing from a minimum in the region of stations 2 and 3 before falling away at station 8 due to tip rounding. However, the rate of increase in chord with radius is less than it would be if the blade width did not vary with angle theta in the way described herein. See also FIG. 16, where the alignment of the sections numbered 1 to 8 on the page allows the distribution of chord with radius to be seen.

As mentioned above the blades may be made conveniently by injection molding in suitable plastics materials. As unobtrusiveness is a desired feature of fan/lights according to the invention, one way of enhancing this is to provide that the blades be formed from a transparent or at least translucent material. This feature is believed to be inventive in itself.

Although the blade stowage arrangement and method described herein provides for stowage of the blades without contact between blades, the described stowage positions of the blades are such that slight sagging of one blade so as to contact another may not cause failure to deploy. It will be noted in FIG. 12 that the sectional view showing the smallest clearance between blade 1 and its next blade 2 is section (g), corresponding to theta=90 degrees. This is thought to be a suitable position for minimum clearance and so for first contact between blades 1 and 2 to occur if after a period of stowage without fan use, blade 1 should sag slightly. It is thought that after such contact between blades 1 and 2, the tendency to further sagging would be limited and the moment arm about axis 21 of any friction force due to blade contact less than for contact between tip 61 of blade 1 and the underlying blade 2, thus, limiting the possibility of a failure of blade 1 to deploy on fan startup.

The possibility of blades that are comparatively thin (so that they may sag over time if not used) also means that the blades when in use may flex upwardly toward their tip ends. This can it is believed advantageously direct air slightly more outwardly as well as downwardly than if the blades were rigid.

The particular shape of the translucent lower section 9 of enclosure 2 is by no means the only possible one. Even a shape that is not of the circular shape in plan, as shown in the FIGS. 1 to 7 could be used as an alternative aesthetic choice.

A further invention will now be disclosed. In fan/lights such as those described by Villella in his aforementioned PCT application, the "sun gear" may comprise a single member to which toothed segments are secured for engagement with the "planet gears", instead of a complete gear. This possibility, which it has been found can reduce manufacturing costs arises because suitable sun and planet gear proportions can be chosen which do not require the sun gear to rotate far enough during deployment and refraction for any one tooth thereof to encounter more than one planet gear.

It will be readily apparent to persons skilled in the art that many other variations and choices can be made to the fan/light described above without exceeding the scope of the invention as stated While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A combined ceiling fan and light fitting having folding fan blades, the fan comprising:

a blade support means arranged to be rotated by a motor about a fan rotation axis;

a plurality of fan blades each having a root end tip;

each blade being secured to the blade support means by being pivotally connected at its root end to the blade support means for rotation about an upright blade pivot axis so as to be moveable between a folded and an operative position, each blade being arranged to move from its folded position to its operative position by centrifugal forces when said motor rotates said blade support means; wherein the tips of said blades in their operating positions rotate in a plane which is higher than that in which the root ends of said blades rotate;

each of the blades is cambered and are concave downward; and each blade has first gear means arranged to rotate with that blade; and the fitting has second gear means mounted so as to be rotatable coaxially relative to the electric motor and the blade support means and each first gear means meshes with the second gear means so that as the blades pivot between their folded and operative positions they are constrained to move in synchronisation with each other because of the meshing of the first and second gear means, wherein a biasing means acts between the blade support means and said sun gear second gear means.

2. A combined ceiling fan and light fitting of claim 1 wherein:

(a) each blade initially rises in height above a datum height with increasing distance along the blade from its pivot axis end so that the blade when in its folded position overlies the pivot axis end of the neighbouring blade in its own folded position, (b) with increasing distance from a pivot-axis end of the air moving portion towards the tip end of the blade the leading edge of the air moving portion first increases in height above the said datum height and then turns downwardly whereby to limit the height of the tip end above the datum height, (c) the air moving portion of each blade is cambered on its upper surface and its lower surface is concave downwards between its leading and trailing edges when seen in cross-section on a cylindrical surface centred on the fan rotation axis and intersecting the air moving portion at a radius between the specified radius and the blade tip end when the blades are in their deployed positions, and wherein the trailing edge when seen in plan view is approximately a circular arc which when the blade is in its folded position is substantially centred on the fan rotation axis.

3. A combined ceiling fan and light fitting according to claim 2 wherein each blade when in its folded position lies within a specified radius from the fan rotation axis and above a light fitting portion and said specified radius is approximately a radius of a light fitting portion that is comprised in the combined ceiling fan and light fitting and located below the blade and that is of circular shape when seen in plan view.

4. A combined ceiling fan and light fitting according to claim 2 wherein the leading edge of the air moving portion of each blade has a peak height above the datum height at a position between the pivot-axis end of the air moving portion and the tip end of the blade.

5. A combined ceiling fan and light fitting according to claim 4 wherein the height above the datum height of the leading edge of the air moving portion declines from said peak height with increasing distance along the leading edge toward the tip end of the blade.

6. A combined ceiling fan and light fitting according to claim 2 wherein for each blade when in its folded position the radial distance between the leading and trailing edges of the air moving portion reduces progressively from a maximum value partway along the length of the air moving portion towards the blade tip end.

7. A combined ceiling fan and light fitting according to claim 2 wherein the air moving portion of each blade has in the deployed position of the blade a maximum angle of incidence to the horizontal at a position partway along the air moving portion the angle of incidence decreasing with increasing distance from that position of maximum incidence towards the tip end of the blade.

8. A combined ceiling fan and light fitting according to claim 7 wherein the position partway along the air moving portion of each blade at which its incidence to the horizontal is a maximum when the blade is in its deployed position is radially inboard of a position at which the blade chord measured along an arc centred on the fan rotation axis is at a maximum value.

9. A combined ceiling fan and light fitting according to claim 2 wherein the number of blades is four and the blades' pivot axes are spaced 90 degrees apart from each other peripherally.

10. A combined ceiling fan and light fitting according to claim 9 wherein that section of each blade between its pivot axis and its tip end when the blade is in its folded position subtends an angle of about 160 to 170 degrees at the fan rotation axis.

11. A combined ceiling fan and light fitting according to claim 9 wherein each blade pivots through an angle of about 180 degrees to move from its folded position to its deployed position.

12. A combined ceiling fan and light fitting according to claim 2 wherein the air moving section of each blade has a rounded leading edge and a sharp trailing edge over at least part of its along-blade length when seen in cross-section on a cylindrical surface centred on the fan rotation axis and intersecting the air moving section at a radius between the specified radius and the blade tip end.

13. A combined ceiling fan and light fitting according to claim 2 wherein the minimum height difference between each blade and its neighbouring blade when the blades are in their folded positions occurs approximately where the blade overlies its neighbouring blade.

14. A combined ceiling fan and light fitting according to claim 2 wherein the leading edges of the air moving portions are stepped upwardly then more gradually increase in height.

15. A combined ceiling fan and light fitting according to claim 14 wherein when the blades are in their folded positions each blade overlies a part of its neighbouring blade which part is received in a gap above the light fitting enclosure and below the underside of the overlying blade said gap existing by virtue of the stepped shape of the overlying blade.

16. A combined ceiling fan and light fitting according to claim 15 wherein each blade is pivotally mounted to a rotating member and said gap lies above a platelike member.

17. A combined ceiling fan and light fitting as claimed in claim 2 wherein each of the blades is moulded from plastics material.

18. A combined ceiling fan and light fitting as claimed in claim 2 wherein when the blades are in their folded positions, the tip of each blade overlies the root end of an adjacent blade for compact folding of the blades.

19. A combined ceiling fan and light fitting according to claim 1 wherein each first gear means is a planet gear and the second gear means is a sun gear.

20. A combined ceiling fan and light fitting according to claim 19 wherein the planet gears are at equal radii from the fan rotation axis.

21. A combined ceiling fan and light fitting according to claim 19 wherein the sun gear is in the form of a centreless ring mounted for limited rotation below the blade support means about said fan rotation axis.

22. A fitting as claimed in claim 1 wherein the biasing means includes one or more tension springs.

23. A combined ceiling fan and light fitting as claimed in claim 1 wherein the root end of each blade is formed as a single part with the remainder of the blade.

24. A combined ceiling fan and light fitting as claimed in claim 1 wherein each blade has a root end portion and a blade portion.

25. A combined ceiling fan and light fitting as claimed in claim 1 wherein:

(a) there are four of said blades equally spaced about said fan rotation axis; and (b) each blade between its pivot axis and its tip subtends an angle of about 160° and 170° at the fan rotation axis.

26. A combined ceiling fan and light fitting as claimed in claim 1 wherein each blade is arranged to move from its folded position to its operative position by centrifugal forces when said motor rotates said blade support means.

27. A combined ceiling fan and light fitting as claimed in claim 1 including an enclosure for mounting at least one electric lamp, the enclosure having a circular periphery centred on the fan rotation axis and wherein the diameter of the enclosure is from about 36% to 42% of the overall diameter of the fitting when the blades are in their operative positions.

28. A combined ceiling fan and light fitting as claimed in claim 1 wherein the leading edge of each blade is concave downwards when the blade is in its folded position and viewed from the fan rotation axis.

29. A combined ceiling fan and light fitting as claimed in claim 1 wherein each of the blades has a leading edge and a trailing edge which is convexly curved when viewed in plan view.

* * * * *